US010702034B2

(12) United States Patent
Chung

(10) Patent No.: US 10,702,034 B2
(45) Date of Patent: Jul. 7, 2020

(54) CONVERTIBLE STRAP HANDBAG

(71) Applicant: Coral Chung, Los Altos, CA (US)

(72) Inventor: Coral Chung, Los Altos, CA (US)

( * ) Notice: Subject to any disclaimer, the term of this patent is extended or adjusted under 35 U.S.C. 154(b) by 34 days.

(21) Appl. No.: 15/614,533

(22) Filed: Jun. 5, 2017

(65) Prior Publication Data

US 2017/0347766 A1 Dec. 7, 2017

Related U.S. Application Data

(60) Provisional application No. 62/345,728, filed on Jun. 3, 2016.

(51) Int. Cl.
*A45C 13/26* (2006.01)
*A45C 9/00* (2006.01)
(Continued)

(52) U.S. Cl.
CPC ..... *A45C 13/26* (2013.01); *A45C 3/06* (2013.01); *A45C 9/00* (2013.01); *A45C 13/30* (2013.01);
(Continued)

(58) Field of Classification Search
CPC .. A45C 13/26; A45C 3/06; A45C 9/00; A45C 13/30; A45C 2009/007;
(Continued)

(56) References Cited

U.S. PATENT DOCUMENTS 294,622 A 3/1884 Hoeninger
432,607 A 7/1890 Dwyer
(Continued)

FOREIGN PATENT DOCUMENTS

CN 201431060 Y 3/2010
DE 3002106 A1 7/1981

OTHER PUBLICATIONS

Heshe Women's Vintage Leather Backpack Casual Daypack for Ladies and Girls, https://www.amazon.com/dp/B01ESSA1BW/?coliid=I1AT9MSS7EQYYL&colid=1W4FOW1HFC9N0&psc=0&ref_=lv_ov_lig_dp_it, Date first listed on Amazon: Apr. 26, 2016 (Year: 2016).*
(Continued)

*Primary Examiner* — Tri M Mai
(74) *Attorney, Agent, or Firm* — Intellectual Property Law Group LLP

(57) ABSTRACT

A convertible strap handbag and a method of converting the strap to multiple configurations is described. The handbag comprises a single continuous convertible strap, and wing-shaped left and right panels to allow carrying of large items but sleek enough to use as a purse. A plurality of rings are attached to the back panel to allow the user to convert the strap from a backpack configuration to an over the shoulder configuration without removing or disconnecting the strap. The handle attached to the back panel allows the user to carry the handbag in one's hand or worn in the crook of the elbow. A method of converting the strap from a backpack configuration to an over the shoulder configuration is provided comprising holding the strap at a center section and releasing the handbag to extend a length of the strap for an over a shoulder or a cross-body carrying setting.

16 Claims, 27 Drawing Sheets

(51) Int. Cl.

| | |
|---|---|
| ***A45F 3/04*** | (2006.01) |
| ***A45C 3/06*** | (2006.01) |
| ***A45C 13/30*** | (2006.01) |
| ***A45F 3/14*** | (2006.01) |
| *A45F 3/02* | (2006.01) |

(52) U.S. Cl.
CPC ..... *A45F 3/042* (2013.01); *A45F 3/14* (2013.01); *A45C 2009/007* (2013.01); *A45F 3/02* (2013.01); *A45F 3/04* (2013.01); *A45F 2003/142* (2013.01)

(58) Field of Classification Search
CPC .... A45F 3/042; A45F 3/14; A45F 3/02; A45F 3/04; A45F 2003/142
See application file for complete search history.

(56) References Cited

U.S. PATENT DOCUMENTS

| | | | | | |
|---|---|---|---|---|---|
| 1,735,655 | A * | 11/1929 | Pitkin | A45C 3/06 | 150/108 |
| 1,856,447 | A * | 5/1932 | Williams | A44B 11/24 | 24/312 |
| 3,912,141 | A * | 10/1975 | Appel | A45C 13/30 | 150/108 |
| 4,919,240 | A * | 4/1990 | Tobias | A45C 7/0063 | 150/108 |
| 5,797,529 | A | 8/1998 | Lavine | | |
| 6,471,105 | B1 | 10/2002 | Ammerman et al. | | |
| D497,947 | S * | 11/2004 | Kaneda | D19/32 | |
| D530,508 | S * | 10/2006 | Delafontaine | D3/243 | |
| 8,657,169 | B2 * | 2/2014 | Demskey | A45C 13/30 | 224/579 |
| D761,555 | S * | 7/2016 | Philo | D3/232 | |
| D778,615 | S * | 2/2017 | Georges | D3/216 | |
| D790,849 | S * | 7/2017 | Fusi | D3/217 | |
| D794,947 | S * | 8/2017 | Gavriel | D3/217 | |
| 2010/0213224 | A1 | 8/2010 | Barr | | |
| 2010/0306902 | A1 * | 12/2010 | Bourque | A41D 27/08 | 2/244 |
| 2012/0111680 | A1 | 5/2012 | Goolrick | | |

OTHER PUBLICATIONS

The SAK Ventura Convertible Backpack, https://www.amazon.com/dp/B004H0MAZW/?coliid=I38H4IM08MARDM&colid=1W4FOW1HFC9N0&psc=0&ref_=lv_ov_lig_dp_it, Date first listed on Amazon: Feb. 14, 2011 (Year: 2011).*

2015 Backpack Campus Style, https://www.aliexpress.com/item/2015- Backpack-Campus-Style-Women-Leather-Backpacks-Ladies-Girls-School-Shoulder-Bags-Lovely-Bags-Free-Shipping/32378438656.html, date: Dated about 2013 (360DEGREES Without Dead Angle , (Year: 2013).*

The Sak Ventura Backpack, https://www.youtube.com/watch?v=WNO6362I7r0&index=5&t=0s&list,Youtube.com, dated Jan. 31, 2014 (Year: 2014).*

International Search Report, dated Jan. 12, 2018, for corresponding International Application No. PCT/US2017/036009.

Written Opinion of the International Searching Authority, dated Jan. 12, 2018, for corresponding International Application No. PCT/US2017/036009.

China Office Action dated Apr. 24, 2020 for corresponding China application No. 201780048083.3 with English translation.

* cited by examiner

CONVERTIBLE STRAP HANDBAG

CROSS-REFERENCE TO RELATED APPLICATION

This application claims the benefit of U.S. Provisional Application No. 62/345,728, filed Jun. 3, 2016, which is hereby incorporated by reference in its entirety.

FIELD OF THE INVENTION

This invention relates to bags, more specifically to handbags that are multifunctional and can be used at least as a shoulder bag, briefcase, backpack, or satchel. The straps of the handbag are easily convertible and can be worn in at least four or more different positions without removing the strap from the handbag: cross-body, on the arm, on the shoulder, or as a backpack.

BACKGROUND

People who use large handbags often get tired of carrying their handbags with their arms or when a user needs to free their hands, it would be impossible with a handbag unless the user puts the handbag down. During travel, especially in a busy area such as an airport or train station, putting one's handbag down runs the risk of it getting stolen or stained/damaged. Furthermore, it is also difficult to run with a handbag as it is cumbersome and impedes arm movement.

Today's handbags are usually designed for one purpose. If the person needs a briefcase, then one would use a briefcase dedicated to holding at least a computer, documents. If the person also needs a purse, then the individual would have a purse to carry personal items in addition to the briefcase. A multifunctional bag, such as a tote, tends to be bulky or large in appearance. A multifunctional bag that is large enough to carry a computer and other large items, but sleek enough to use as a purse does not exist.

Handbag straps tend to be permanent and do not allow the user to switch the position in which the individual carries the bag. If the straps are convertible, it usually requires the user to remove and reattach the strap in a different position. Or it requires the user to remove the old strap and connect a brand new strap designed for the new position. This makes it difficult for the user to convert the straps to different configurations and to convert it quickly. When the individual is running to catch the train, there is no time to change the straps on a handbag. Furthermore, existing handbags with adjustable straps are limited to only a few configurations.

Accordingly, there is a need for a versatile handbag that is large enough to carry a computer and other large items but classy and sleek enough to use as a handbag. There is a need for a bag to look like a satchel but functions like a backpack. There is also a need for quick, easy, and seamless converting of straps to cross-body, on the arm, shoulder, and backpack configurations without having to remove and reattach straps.

SUMMARY

An object of invention is to have a bag that is multifunctional and can be used at least as a satchel and a briefcase. Another object is to easily convert the bag into at least four different positions without having to remove and reattach the shoulder strap. The at least four different positions comprise: cross-body, on the arm, shoulder and backpack.

According to an embodiment of the present invention, there is a convertible strap handbag comprising: a single strap having a first end, a second end, and a center section, the center section having a first width, and a length of the strap extending from each side of the center section to the first end and second end respectively having a second width, wherein the first width of the center section is larger than the second width, and a plurality of spaced apart rings attached to a back panel of the handbag, through which the strap is engaged. The handbag further comprises a first set of two rings located at an upper section of the back panel and a second set of two of two rings located at a lower section of the back panel, a diameter of each of the rings being larger than the second width and smaller than the first width such that the center section is prevented from passing though the rings, wherein the strap is convertible to different carrying configurations without disconnecting the strap after engagement through the rings and securement to the handbag. In a further embodiment, the handbag further comprises a receptacle having a bottom panel extending to meet a front panel and extending to meet the back panel; a right panel connecting right side edges of the front panel to right side edges of the back panel and a left panel connecting left side edges of the front panel to left side edges of the back panel. In another embodiment, the right pane and the left panel are wing-shaped. In a further embodiment, the handbag comprises a handle attached to a top of the handbag. In embodiments, the handbag has a strap threaded through a plurality of rings attached to the back panel and the plurality of rings are substantially spaced apart to allow the strap to convert to different configurations when the handbag is in use.

According to an embodiment of the present invention there is a handbag with a single removable convertible strap, the handbag has a receptacle that has a bottom panel extending to a front panel and a back panel and a right panel and a left panel connecting the front panel and the back panel. The removable strap is connected to a plurality of rings attached to the back panel and the plurality of rings are substantially spaced apart to allow the strap to convert to different configurations when the handbag is in use.

According to an embodiment of the present invention, there is a method of converting a carrying position of a convertible strap handbag according to the above-described embodiment, the method comprising holding the strap at the center section and releasing the handbag to extend a length of the strap for an over a shoulder or a cross-body carrying setting. In a further embodiment, the method of converting a carrying position of a convertible handbag further comprising pulling a length of strap between the first set of two rings and the second set of two rings at a left side of the handbag, and pulling a length of strap between the first set of two rings and the second set of two rings at a right side of the handbag, until the center section reaches and stops at the first set of two rings, for conversion to a backpack carrying setting. In a further embodiment, the method of converting a carrying position of a convertible handbag further comprising holding the strap at the center section to extend the length of the strap back to the over the shoulder or cross-body carrying setting, without separating the strap or removing the strap from the handbag.

These features, advantages and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

Figure 1:
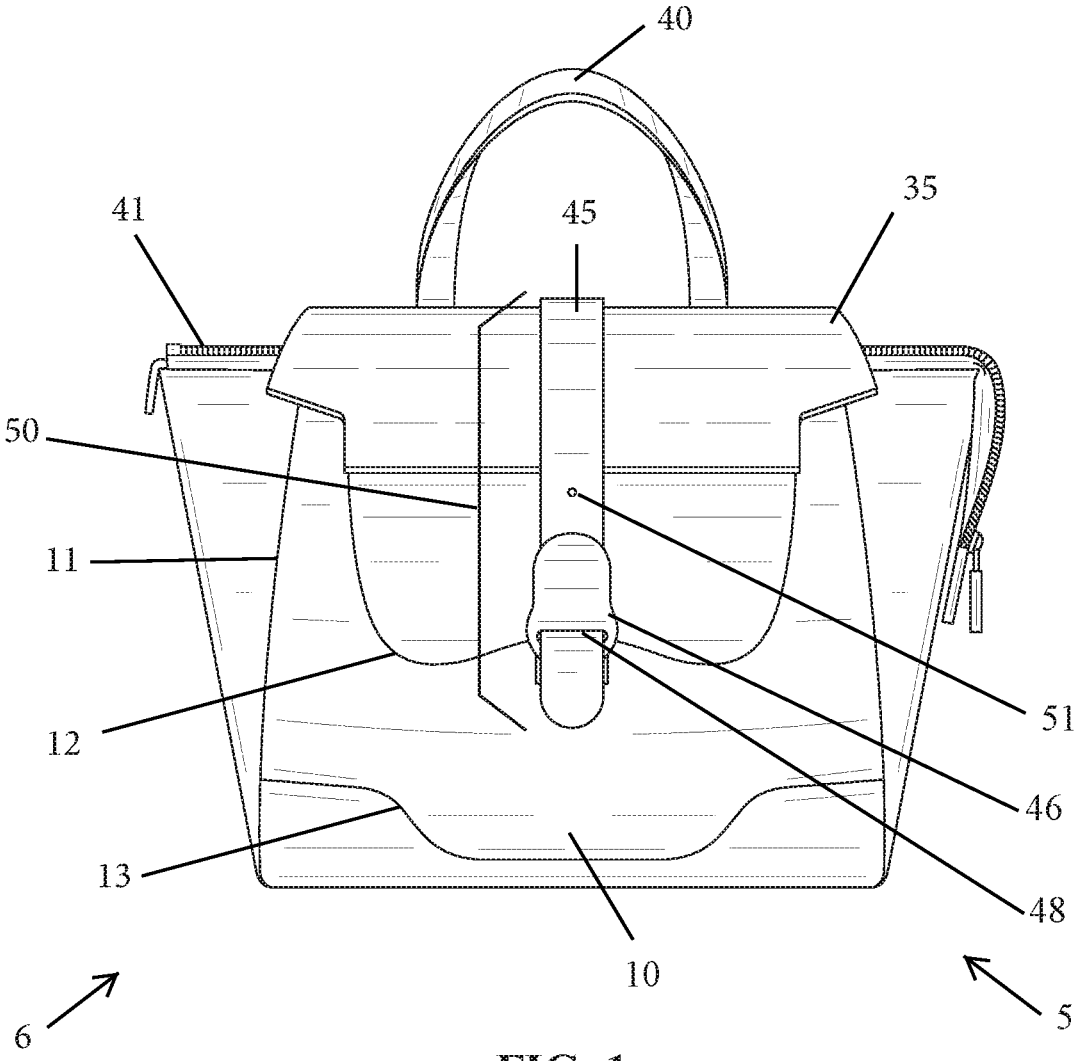
FIG. 1 illustrates a front view of a handbag, according to an embodiment of the present invention.

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

The embodiments of the present invention as described allow a user to wear the handbag 5 as a satchel, tote, crossbody, or backpack. The handbag 5 can be made of water-resistant leather or other similar materials. A preferred leather is pebbled and *mimosa.*

FIGS. 1-9 illustrate an embodiment of the handbag 5 comprising a bag 6 that has a front panel 10, back panel 15, left panel 20, right panel 25, bottom panel 30, a plurality of bag studs 31, a flap 35, a handle 40, a zipper 41, a belt loop 50, a single shoulder strap 54, and a plurality of rings 74 comprising a right top ring 75, right lower ring 80, the left top ring 85 and a left lower ring 90. Embodiments of the present embodiment can function as a satchel or a backpack. The most common way of using the present embodiment is holding it from the handle 40 and in this configuration the bag 6 can double as a handbag 5 and a briefcase. The handle 40 is designed so the user can hold the bag 6 close to their body and close to the center of gravity. This makes the bag 6 feel lighter. The handle 40 is flat but other shapes can be contemplated. The flat shape increases the comfort level.

FIG. 1 illustrates the front panel 10 of the bag 6 having detailed vertical stitching 11 on opposing left and right ends. The vertical stitching 11 creates an illusion making the bag 6 thinner and smaller than its actual size. The vertical stitching 11, horizontal stitching 12, and lower horizontal stitching 13 draws a person's eye to the center of the bag 6; therefore the actual width of the bag 6 is not as noticeable. However, different variations of this stitching can be contemplated and also no stitching on the front panel 10 can also be contemplated in other embodiments of the present invention.

The bag 6 comprises a flap 35 and can be secured to the front panel 10 using the belt loop 50. The belt loop 50 further comprises a secure strap 45, secure strap holes 48, a frame 46, and a belt loop hole 51. The bag 6 can close by using the zipper 41. Another method of closing the bag 6 is by using a magnet. In this case, the user is not required to buckle the belt loop 50 and may secure the flap 35 by a magnetic closure, for example, between the flap 35 and the front panel 10; or between the secure strap 45 and the front panel 10. The user can use either the handle 40 or shoulder strap 54 to carry the bag 6. The drop handle 40 is about 5.5 inches. To change from backpack to shoulder strap configuration, the user simply needs to hold the top portion of the shoulder strap 54 and let the bag 6 drop. The length of the shoulder strap 54 extends through the top right ring 75 and top left ring 85 to form the shoulder strap configuration. This conversion from a backpack to shoulder strap setting is achieved in a single seamless motion, without requiring any disconnection or reattachment of parts, nor requiring the user to place the handbag on any surface to make the adjustment.

Figure 2:
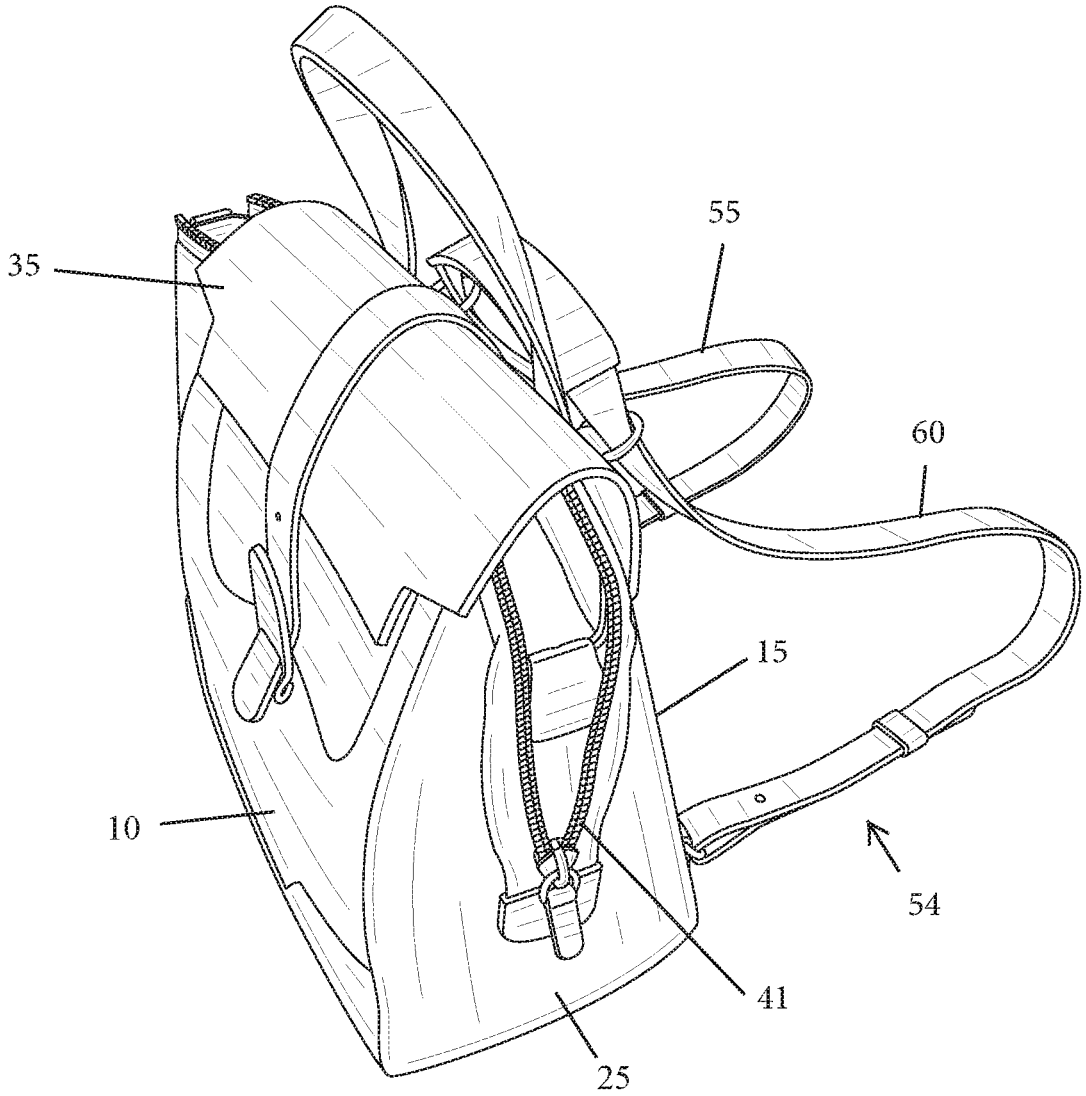
FIG. 2 illustrates a top perspective view from FIG. 1, according to an embodiment of the present invention.

FIG. 2 illustrates the right panel 25 of the bag 6. The right panel 25 is where the front panel 10 and the back panel 15 meet. The zipper 41 extends towards the right panel 25. The bag 6 can be unzipped having the inside of the bag exposed as illustrated in FIG. 2 but because the bag 6 has a flap 35 and belt loop 50, the user can secure their contents in the bag 6 using this mechanism instead. By using the belt loop 50 to close the bag 6, it allows the bag 6 to expand and carry larger items securely. In the backpack mode as illustrated in FIG. 2, the single shoulder strap 54 forms a left shoulder strap 55 and a right shoulder strap 60. The left shoulder strap 55 formed by a length of the shoulder strap 54 pulled between the top left ring 85 and bottom left ring 90; the right shoulder strap 60 formed by a length of the shoulder strap 54 pulled between the top right ring 75 and the bottom right ring 80.

Figure 3:
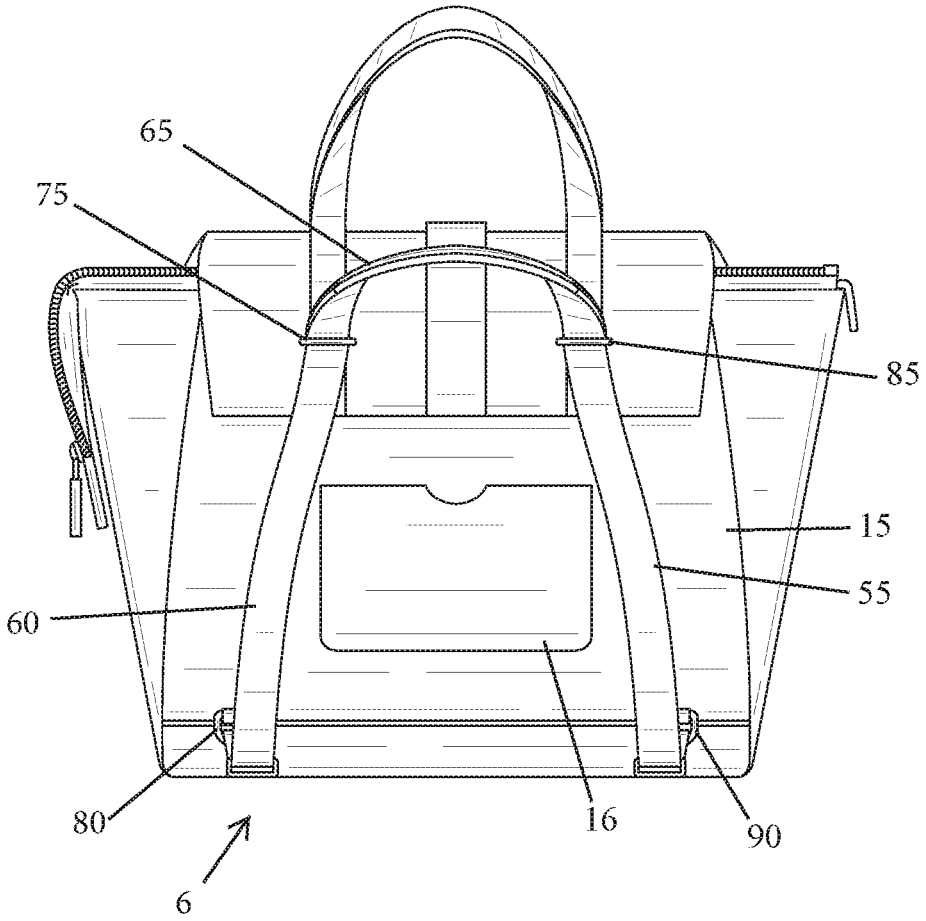
FIG. 3 illustrates a rear view from FIG. 1, according to an embodiment of the present invention.

FIG. 3 illustrates the back panel 15 of the bag 6. The angle of the left shoulder strap 55 and right shoulder strap 60 make it comfortable on the shoulder when used in backpack mode. The back panel 15 comprises a back panel pocket 16 where users can keep their cards. The back panel 15 further comprises the plurality of rings 74 made up of a right top ring 75, a right lower ring 80, a left top ring 85, and a left lower ring 90. FIG. 3 illustrates the bag 6 in a backpack mode because both the left shoulder strap 55 and right shoulder strap 60 are slidably pulled downward until each side of the center section of the shoulder strap 54, hereinafter referred to as the stopper 65, makes contact against the right top ring 75 and left top ring 85 respectively. A width of the stopper 65 is larger than a diameter of the top rings 75 and 85. The width between the right top ring 75 and left top ring 85 is designed to make the left shoulder strap 55 and right shoulder strap 60 comfortable for the user's shoulder. The width between the right lower ring 80 and lower left ring 90 make it comfortable for the user because it gently hugs the user's waist. This mode can be used when the individual requires both of their hands or when the user is running. It can be contemplated that the location of the rings 74 can be changed on the back panel 15. The rings 74 can be D-rings, round rings, or any other hardware that will allow the left shoulder strap 55 and right shoulder strap 60 to removably slide through.

Figure 4:
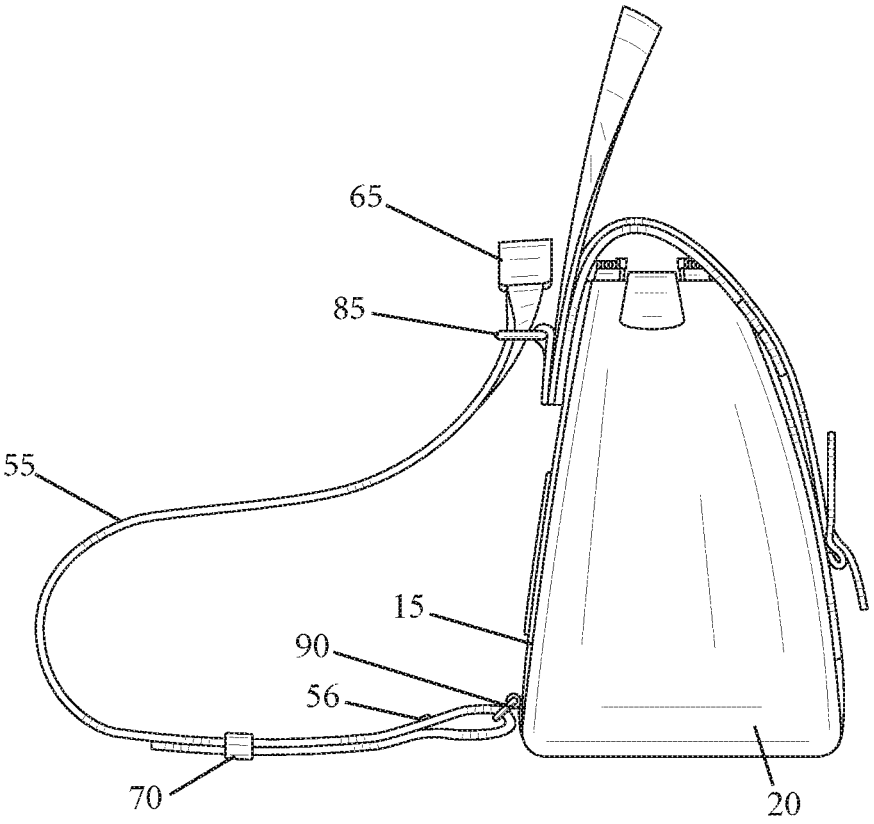
FIG. 4 illustrates a left elevational view from FIG. 1, according to an embodiment of the present invention.
Figure 5:
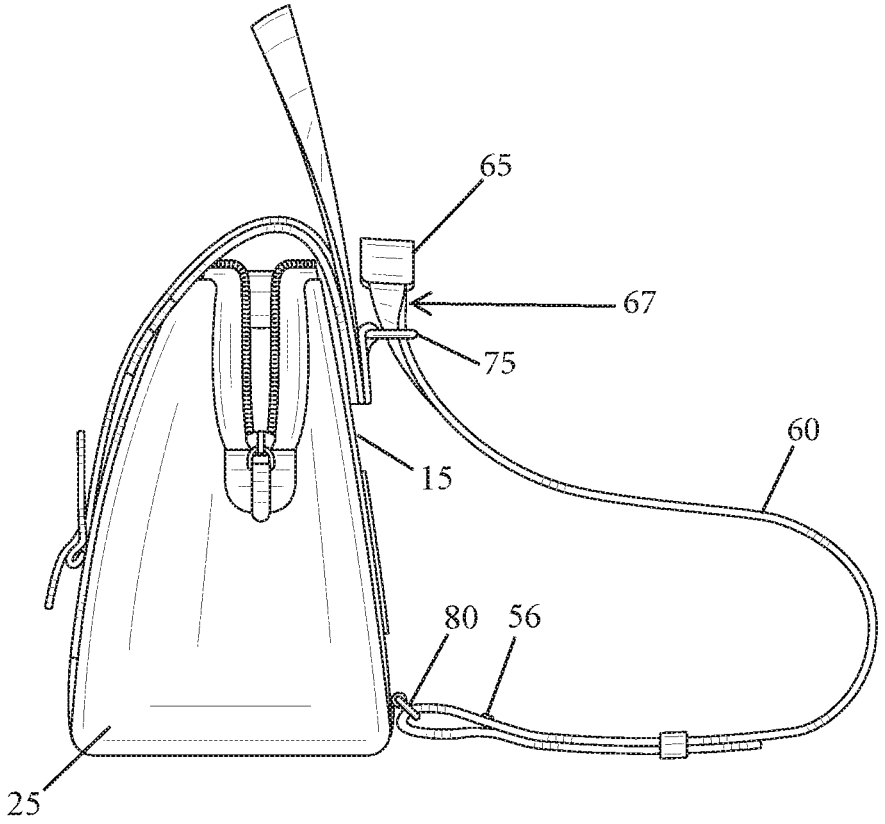
FIG. 5 illustrates a right elevational view from FIG. 1, according to an embodiment of the present invention.

FIG. 4 and FIG. 5 illustrate the left panel 20 and right panel 25 respectively of the bag 6. From a side view, the left panel 20 and the right panel 25 have a narrow top and a wider base. When viewed from the front or rear of the bag 6, (see FIG. 1 and FIG. 3), the left panel 20 and right panel 25 form wing-shaped panels, flaring out from the wider base to the narrow top toward the top of the bag. The top of the bag 6 opens to about 16 inches wide and the base is about 13 inches wide. The height of the bag 6 is about 10 inches. The depth of the bag 6 is about 6 inches. This allows the bag 6 to carry more items and still create the look and feel of a thinner, less bulky bag 6. The interior of the bag 6 can carry a laptop computer. The slanted back panel 15 makes it snug against the user's back when used in backpack mode. When extended fully, the left shoulder strap 55 and right shoulder strap 60 are loops with large enough diameters making it easy for the user to quickly put the backpack on. The user can also wear the backpack on only one shoulder rather than both. In the backpack form, the shoulder strap 54 is removably looped into the right top ring 75 and left top ring 85 until the stopper 65 is against the right top ring 75 and left top ring 85. The stopper 65 allows the user to know how much of the shoulder strap 54 needs to be pulled in order to achieve the required loops made by the left shoulder strap 55 and right shoulder strap 60. The left shoulder strap 55 is slidably pulled through the left top ring 85 and the right shoulder strap 60 is slidably pulled through the right top ring 75. Then the left shoulder strap 55 is slidably pulled through the left lower ring 90 and the right shoulder strap 60 is slidably pulled through the right lower ring 80. Once the right shoulder strap 60 and left shoulder strap 55 are removably looped into the right lower ring 80 and left lower ring 90, the user can choose to make the diameter of the right shoulder strap 60 and left shoulder strap 55 smaller or larger by sliding more of the strap through the right lower ring 80 and left lower ring 90. Once the desired diameter is achieved, each strap can fold back on itself and is secured to itself using a shoulder strap stud 56. The excess length of the left shoulder strap 55 and right shoulder strap 60 can be feed through and held in place by the shoulder strap loop 70.

Figure 6:
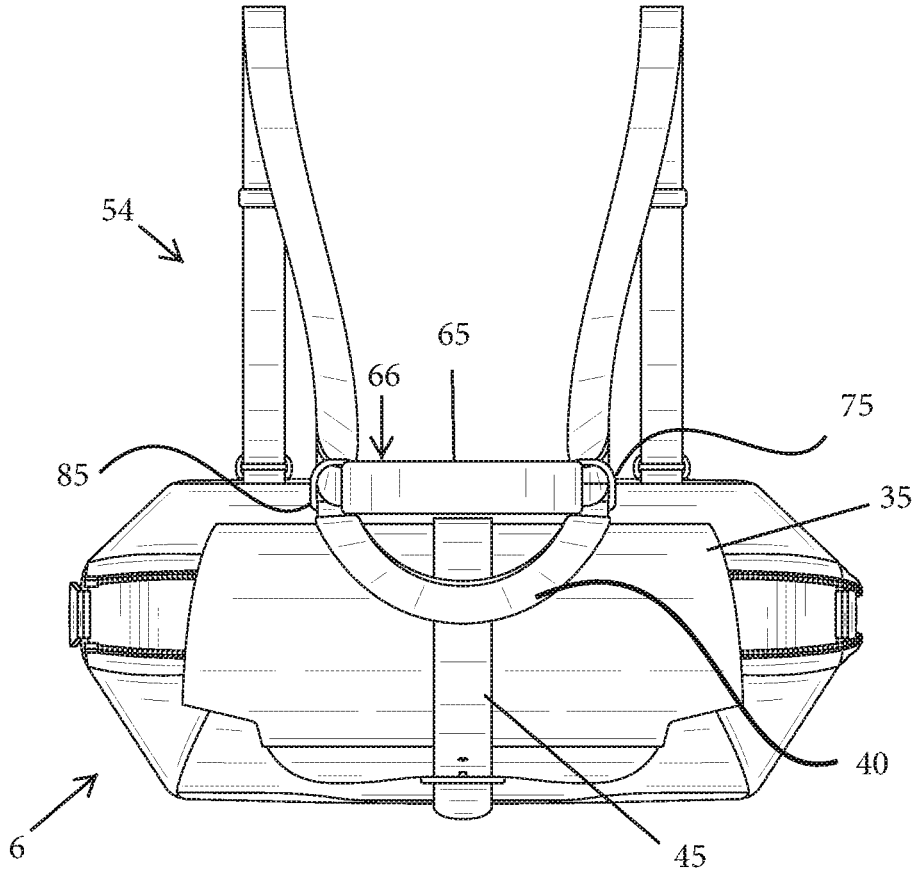
FIG. 6 illustrates a top view from FIG. 1, according to an embodiment of the present invention.

FIG. 6 illustrates the flap 35 and the secure strap 45 which is attached to the flap 35. The bag 6 is in backpack mode with the stopper 65 tightly wedged against the right top ring 75 and left top ring 85. The handle 40 gives the user the option to hold the bag 6 with a user's hand or at the crook of the user's elbow.

The shoulder strap 54 having a wider center section of strap, referred to as the stopper 65, and a thinner portion of the strap on each side of the stopper 65. The stopper width 66 is shown larger than the strap width 67 on each side of the stopper 65 (not shown, see FIG. 5). The shoulder strap 54, the bag 6 and the handle 40 can be made of Italian leather, however, other materials can be contemplated. It is preferable that the shoulder strap 54, the bag 6, and the handle 40 are made of the same material so as to show consistency and a classic look. The function of the stopper 65 allows the user to quickly and easily convert the handbag 5 from an over the shoulder configuration to a backpack configuration because the right top ring 75 and left top ring 85 have diameters which are smaller than the width of the stopper 65, which block the wider edges 66 of the stopper 65 from passing through when the user pulls down on the shoulder strap 54. When the user converts the handbag 5 to an over the shoulder configuration from a backpack configuration, the user engages the stopper 65 to easily grab the shoulder strap 54 and then releases the bag 6 to extend the shoulder strap 54. The stopper 65 has a length which is suited as a handle for easily grasping the strap 54 and for comfortably laying along the top of a shoulder.

The shoulder strap 54 is slidably pulled in the backpack mode. The back panel 15 (not shown, see FIG. 5) comprises of fillers making it stiff so when used in backpack mode or as a cross-body bag 6, the bottom panel 30 does not fold into itself.

Figure 7:
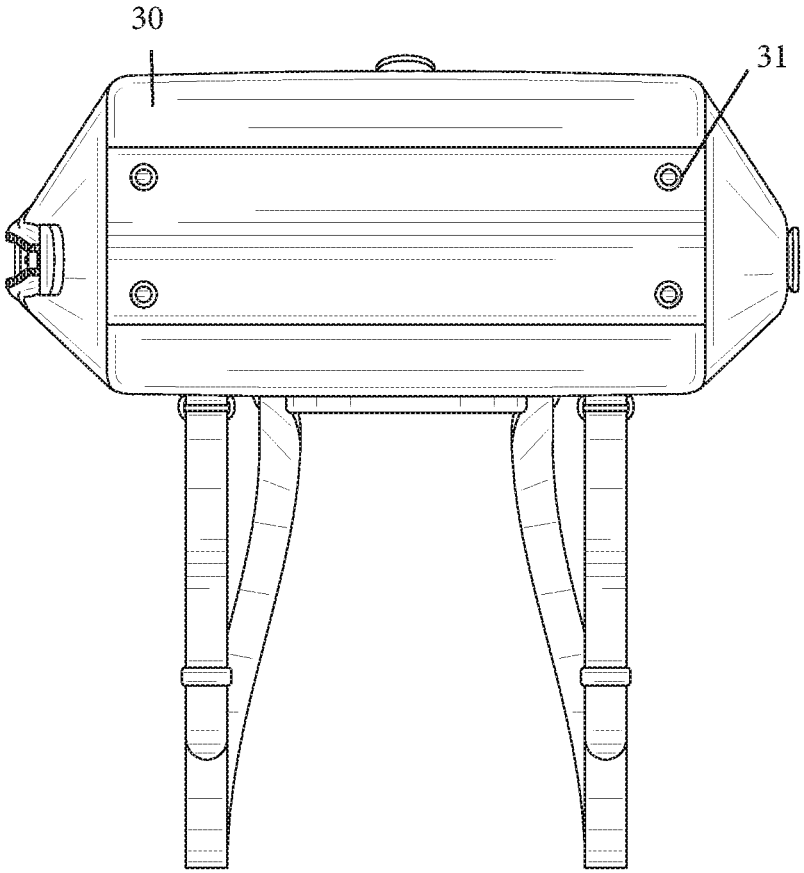
FIG. 7 illustrates the bottom of a handbag comprising a plurality of handbag studs, according to an embodiment of the present invention.

FIG. 7 illustrates the bottom panel 30 of the bag 6 having a plurality of bag studs 31. The bag studs 31 allow the user to place the bag 6 down on a surface without damaging the bottom panel 30 such that the bag studs 31 make contact with the surface.

Figure 8:
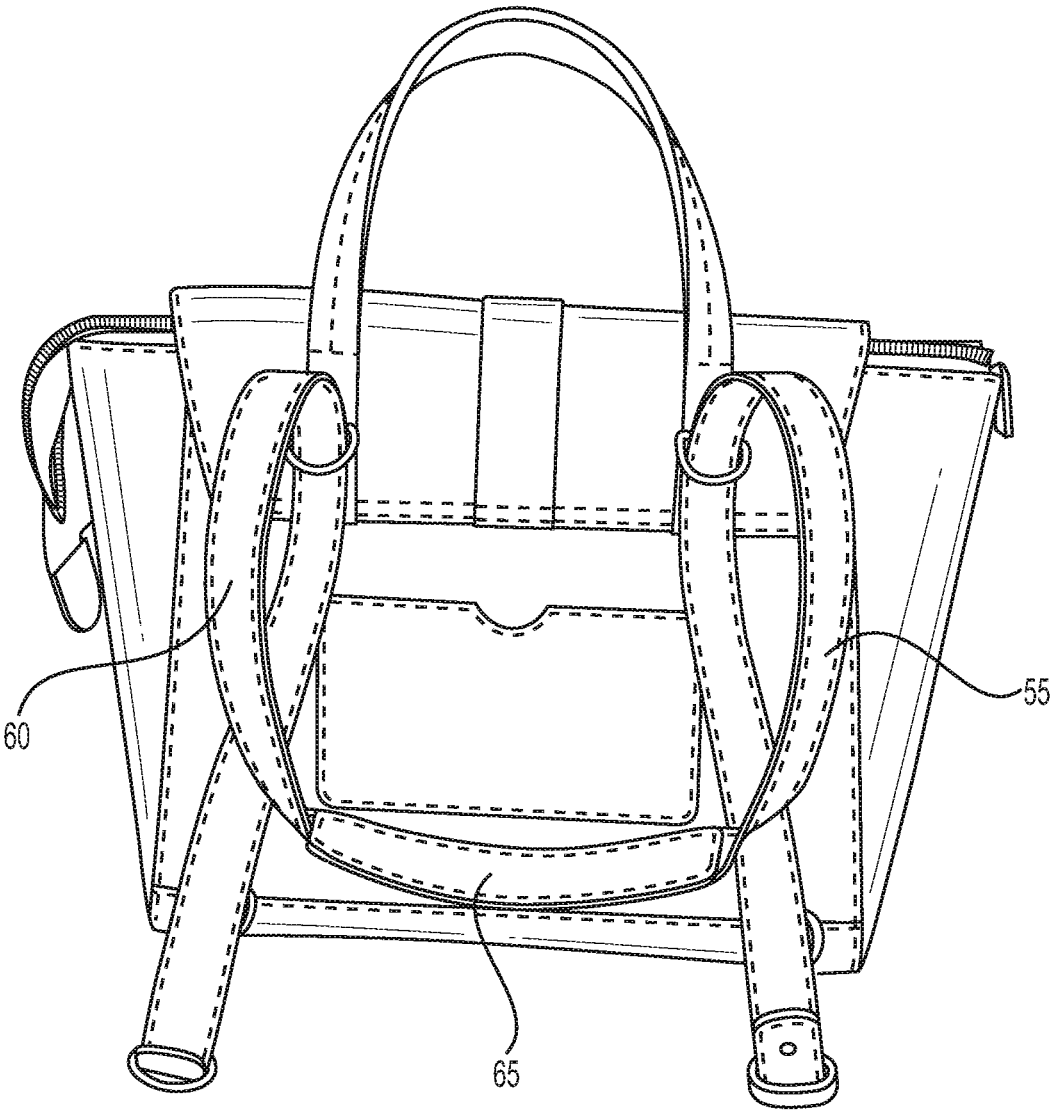
FIG. 8 illustrates the shoulder strap in an intermediate configuration, according to an embodiment of the present invention.
Figure 9:
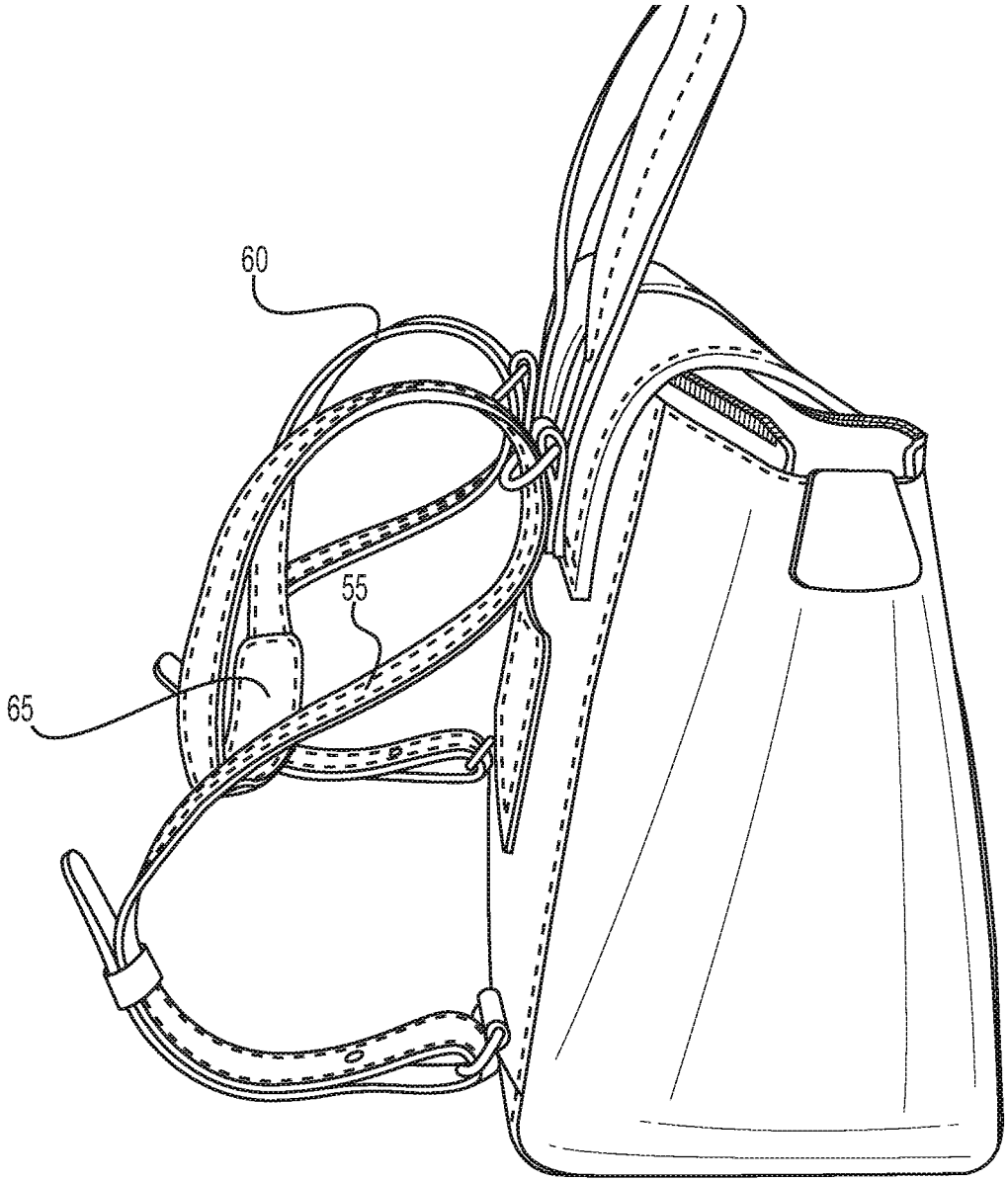
FIG. 9 illustrates a left elevational view from FIG. 8, according to an embodiment of the present invention.
Figure 10:
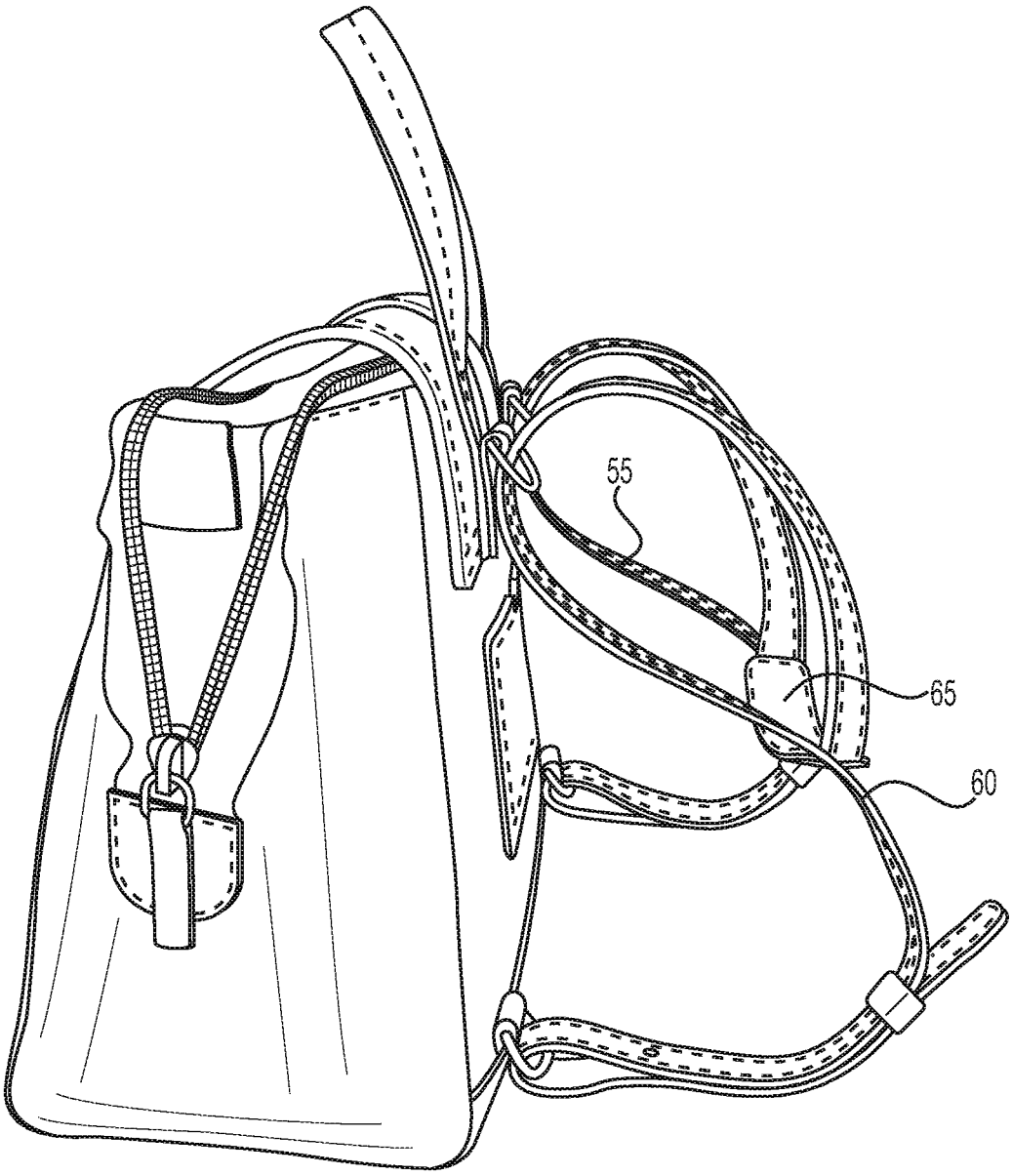
FIG. 10 illustrates a right elevational view from FIG. 8, according to an embodiment of the present invention.

FIGS. 8-10 illustrate the bag 6 in an intermediate mode, between backpack and shoulder strap mode, according to an embodiment of the present invention. The user simply pulls on the stopper 65 until both the left shoulder strap 55 and right shoulder strap 60 shorten and transition into a shoulder strap.

Figure 11:
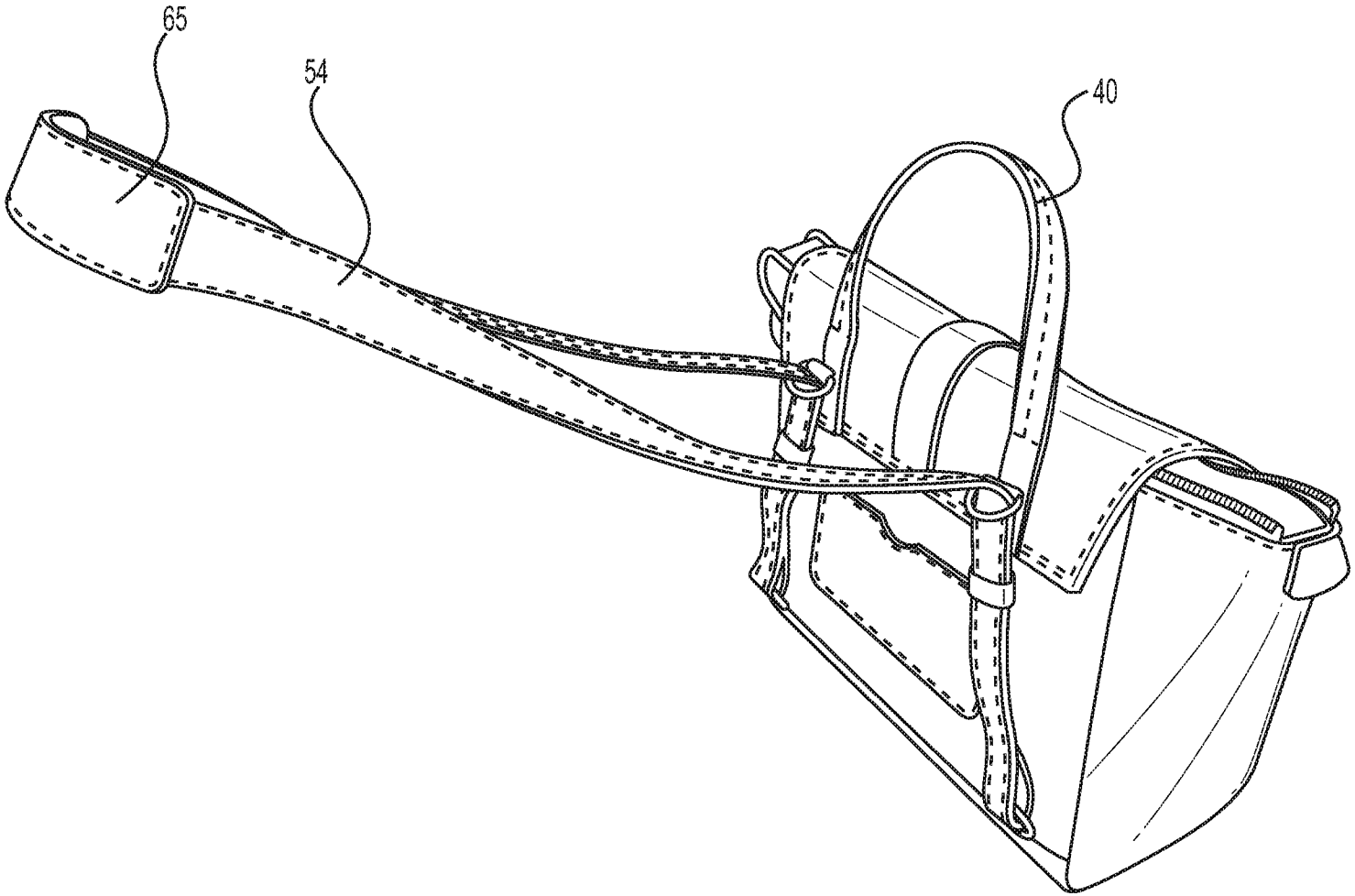
FIG. 11 illustrates a top perspective view of a handbag comprising a strap in a shoulder bag configuration, according to an embodiment of the present invention.
Figure 12:
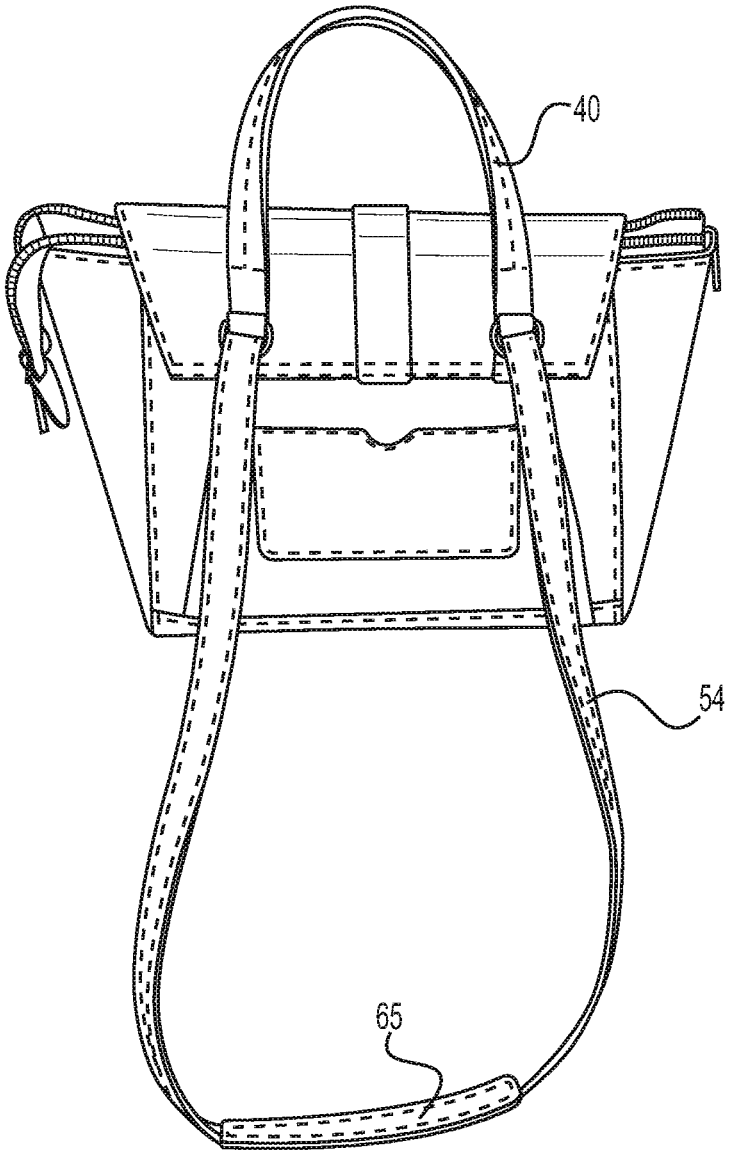
FIG. 12 illustrates a rear view of a handbag comprising a strap in a shoulder bag configuration, according to an embodiment of the present invention.

FIGS. 11-12 illustrate the bag 6 in a shoulder/cross-body mode, according to an embodiment of the present invention. The shoulder strap 54 is fully extended using the stopper 65.

This transformation can be down quickly, seamlessly and with ease because there is no need to remove and reattach the shoulder strap 54. The user also has the option to use the handle 40 to carry the bag 6 when in this mode, allowing the extended strap 54 to simply hang to the side of the bag 6.

Figure 13:
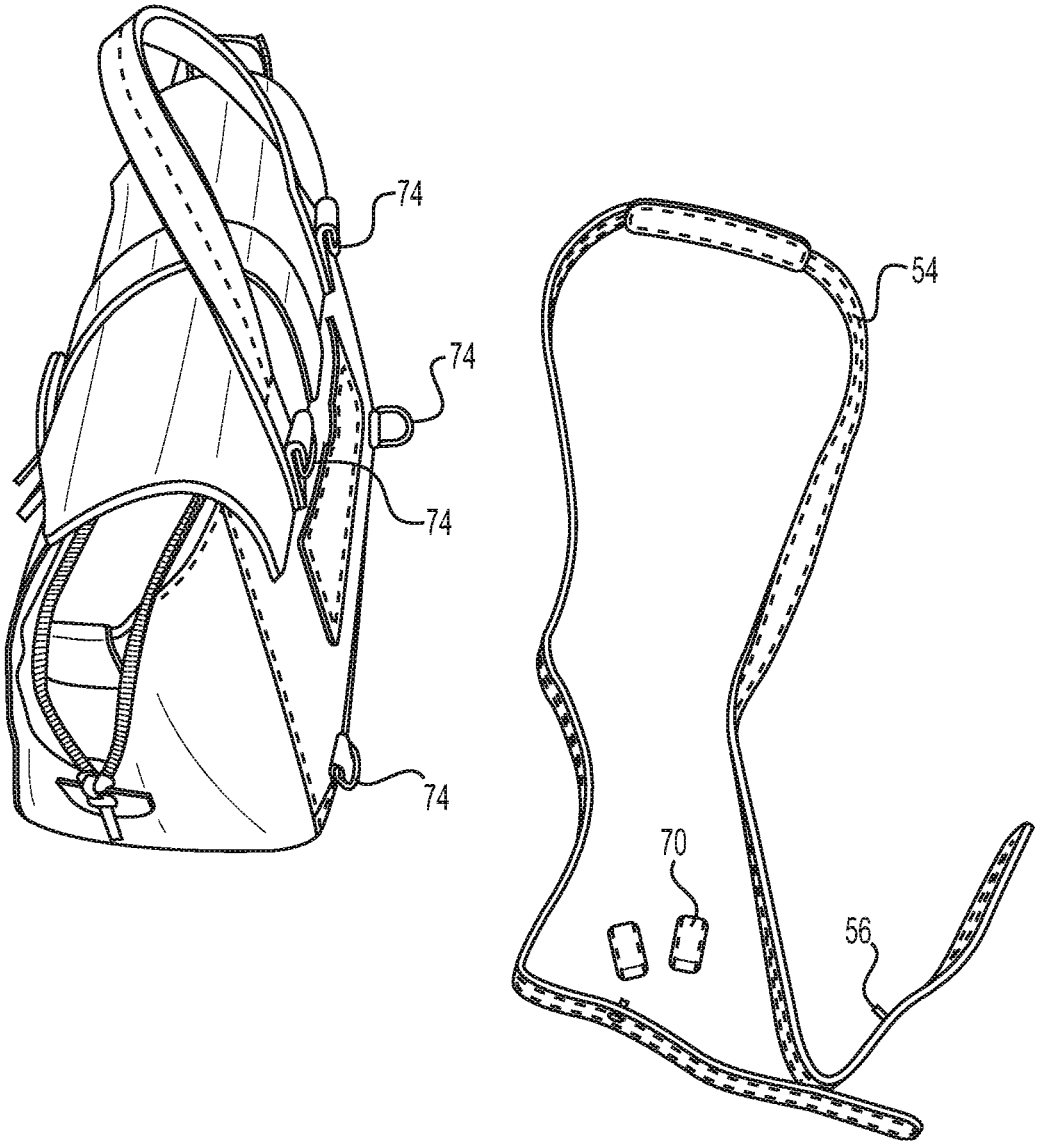
FIG. 13 illustrates a top perspective view of a handbag disconnected from a strap, according to an embodiment of the present invention.

FIG. 13 illustrates that the shoulder strap 54 is completely removable from the bag 6. The shoulder strap loops 70 are also removable from the shoulder strap 54. The shoulder strap 54 is one continuous piece and it is through the engagement at the rings 74 that convert the one shoulder strap 54 into two shoulder straps—a left shoulder strap 55 and a right shoulder strap 60. The shoulder strap 54 is adjustable by using only one hand. The shoulder strap 54 is about 5.5 to 12 inches in length. The shoulder strap 54 comprises shoulder strap studs 56 and shoulder strap stud holes 57 (not shown, see FIG. 15). The shoulder strap studs 56 secure the shoulder strap 54 around the rings 74 when inserted into the shoulder strap stud holes 57.

Figure 14:
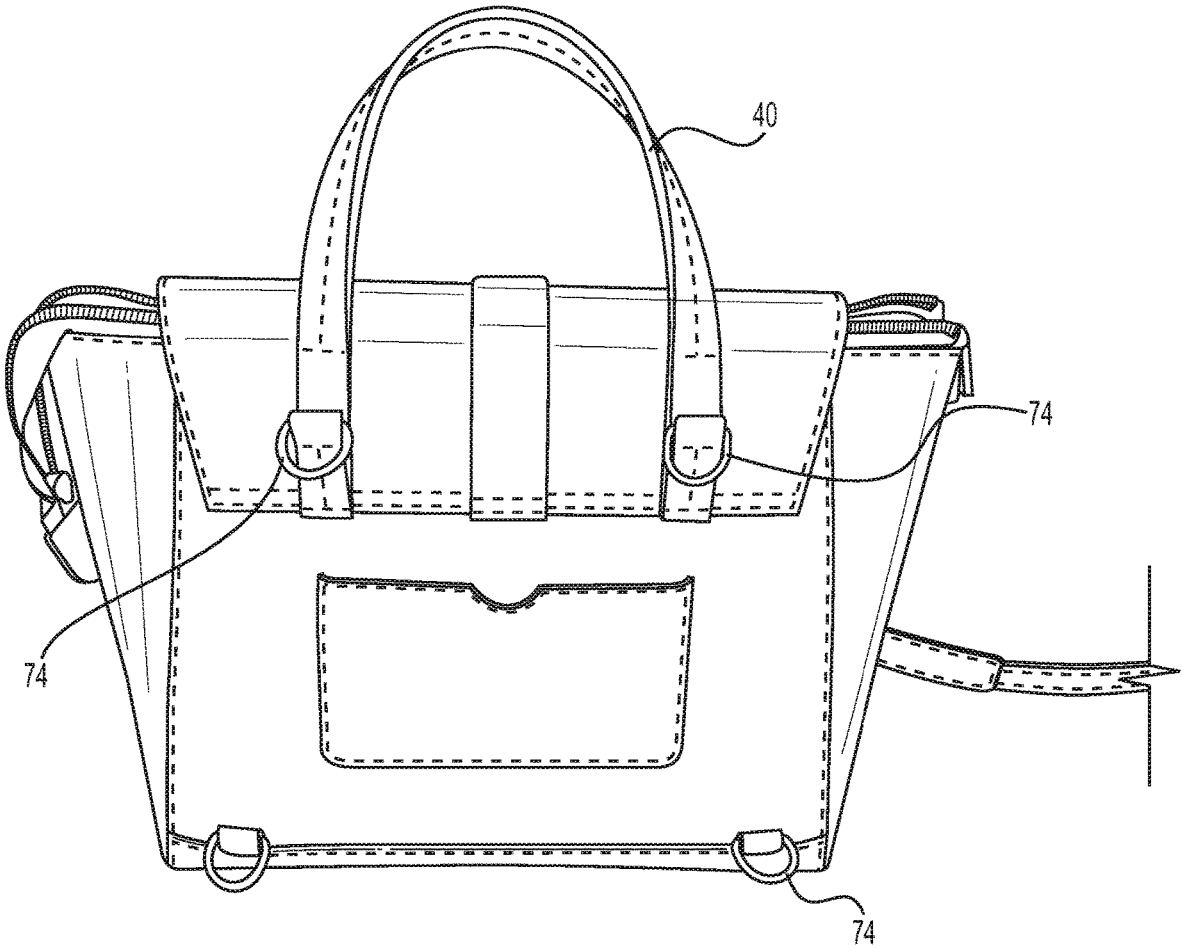
FIG. 14 illustrates a rear view of a handbag without a strap, according to an embodiment of the present invention.

FIG. 14 illustrates how the bag 6 can still be used even when the shoulder strap 54 is completely removed by using the handle 40, according to an embodiment of the present invention. The rings 74 are not bulky so even when exposed, look sleek and unnoticeable. The right top ring 75 and left top ring 85 are not removable from the back panel 15. The right top ring 75 and left top ring 85 sit flat against the back panel 15. Similarly, the right lower ring 80 and left lower ring 90 are not removable from the back panel 15. The right lower ring 80 and left lower ring 90 can also sit flat against the back panel 15.

Figure 15:
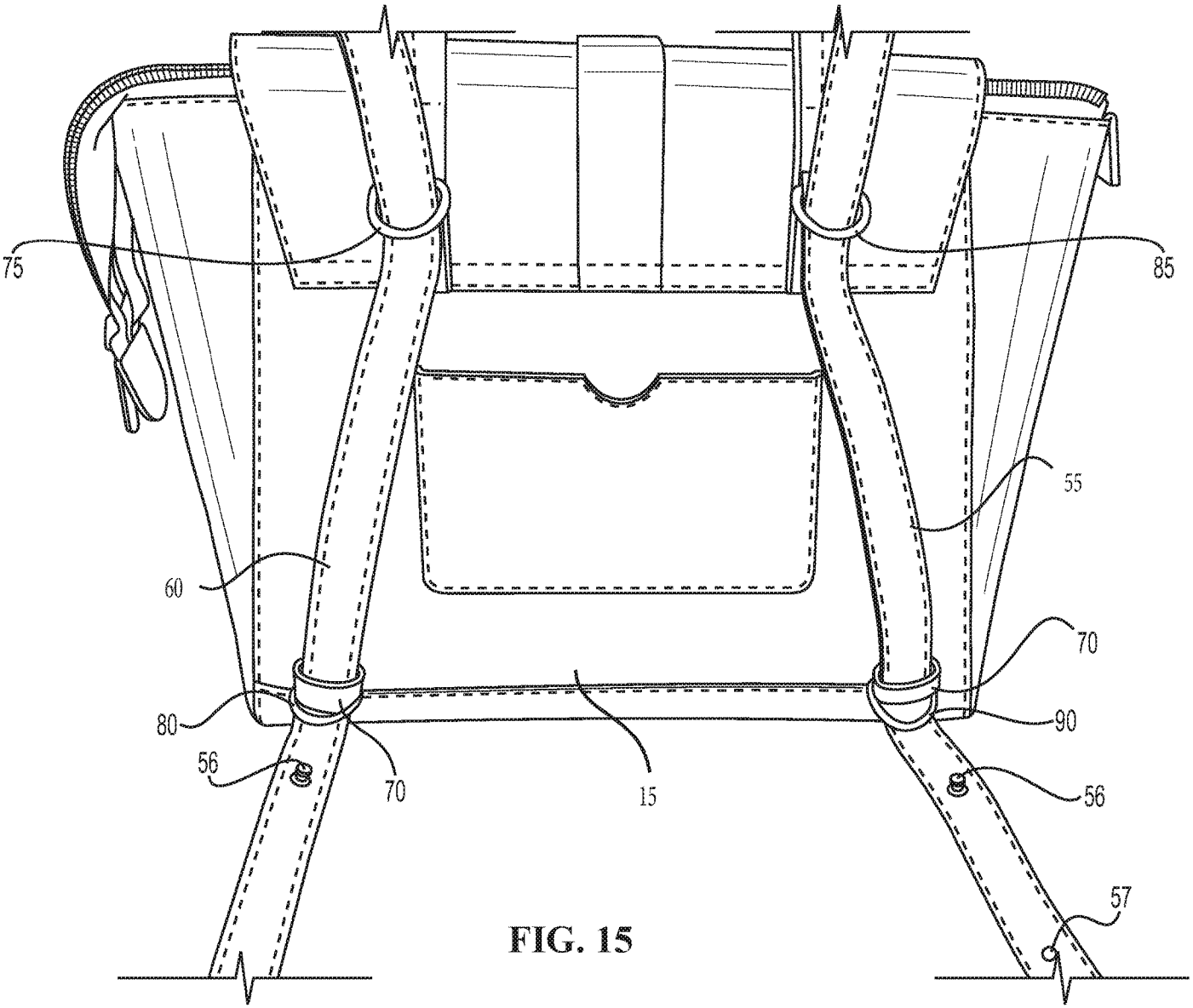
FIG. 15 illustrates a detailed view of the four rings, according to an embodiment of the present invention.
Figure 16:
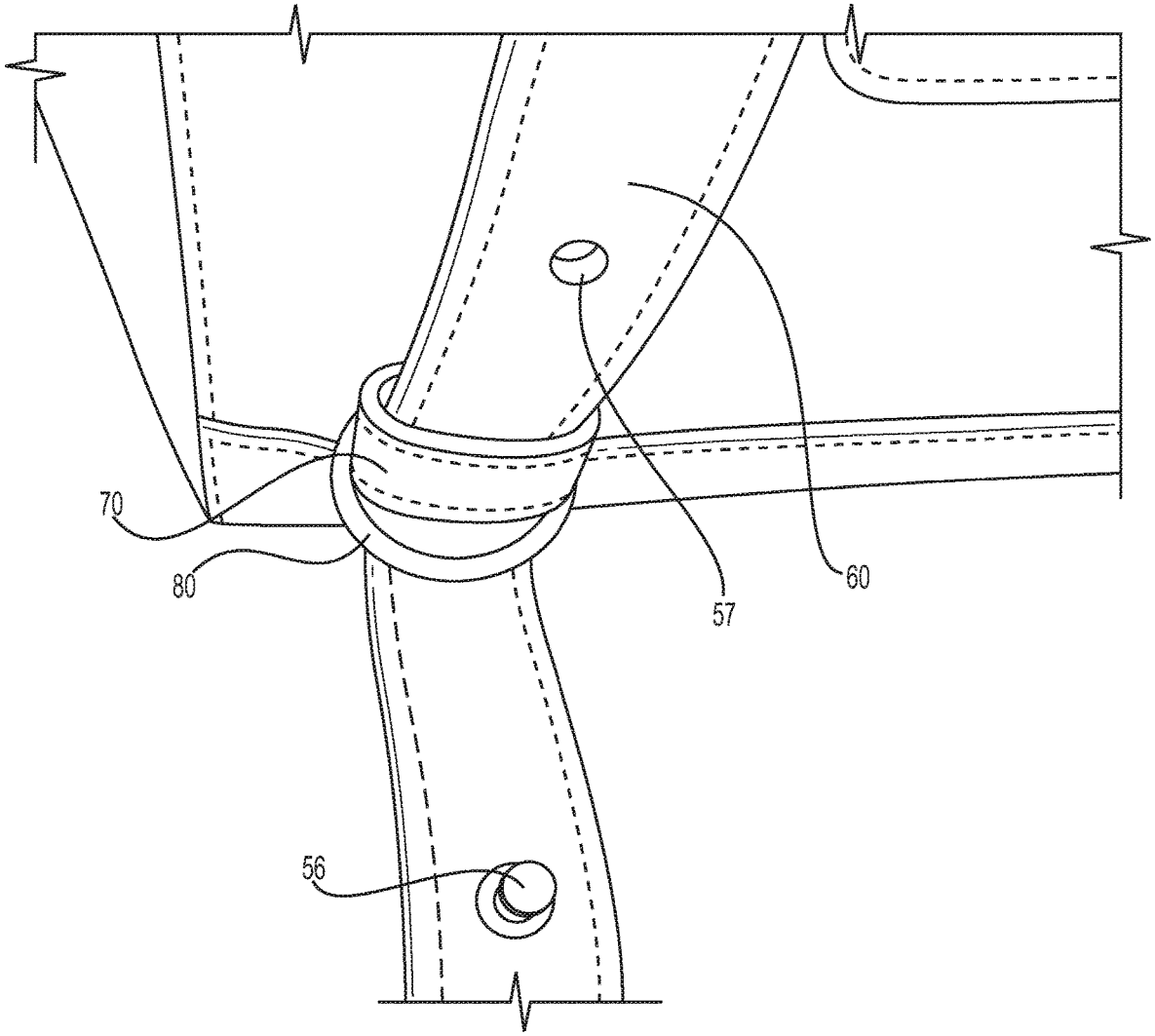
FIG. 16 illustrates a detailed view of the lower right ring, according to an embodiment of the present invention.
Figure 17:
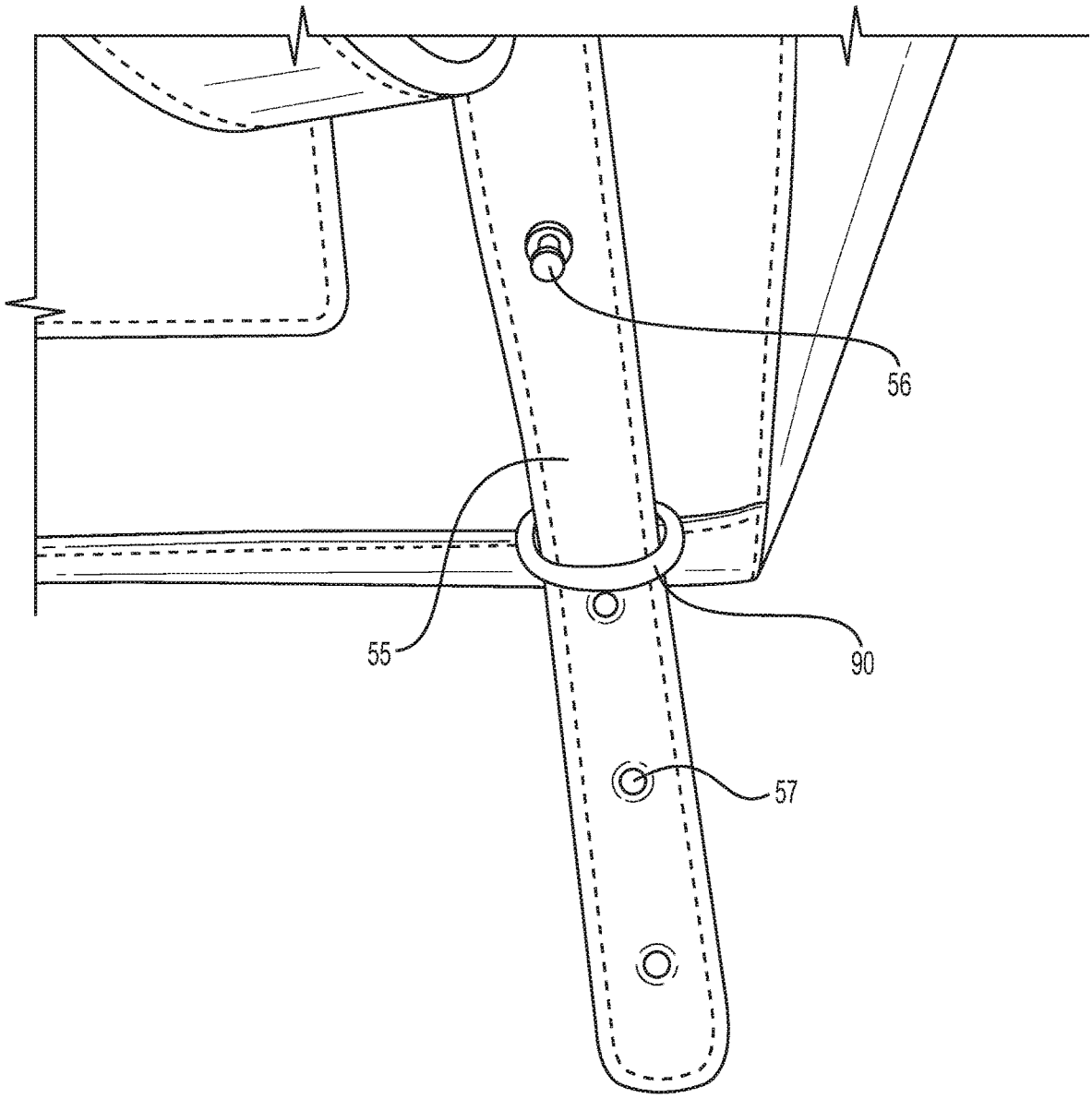
FIG. 17 illustrates yet another detailed view of the lower left ring, according to an embodiment of the present invention.
Figure 18:
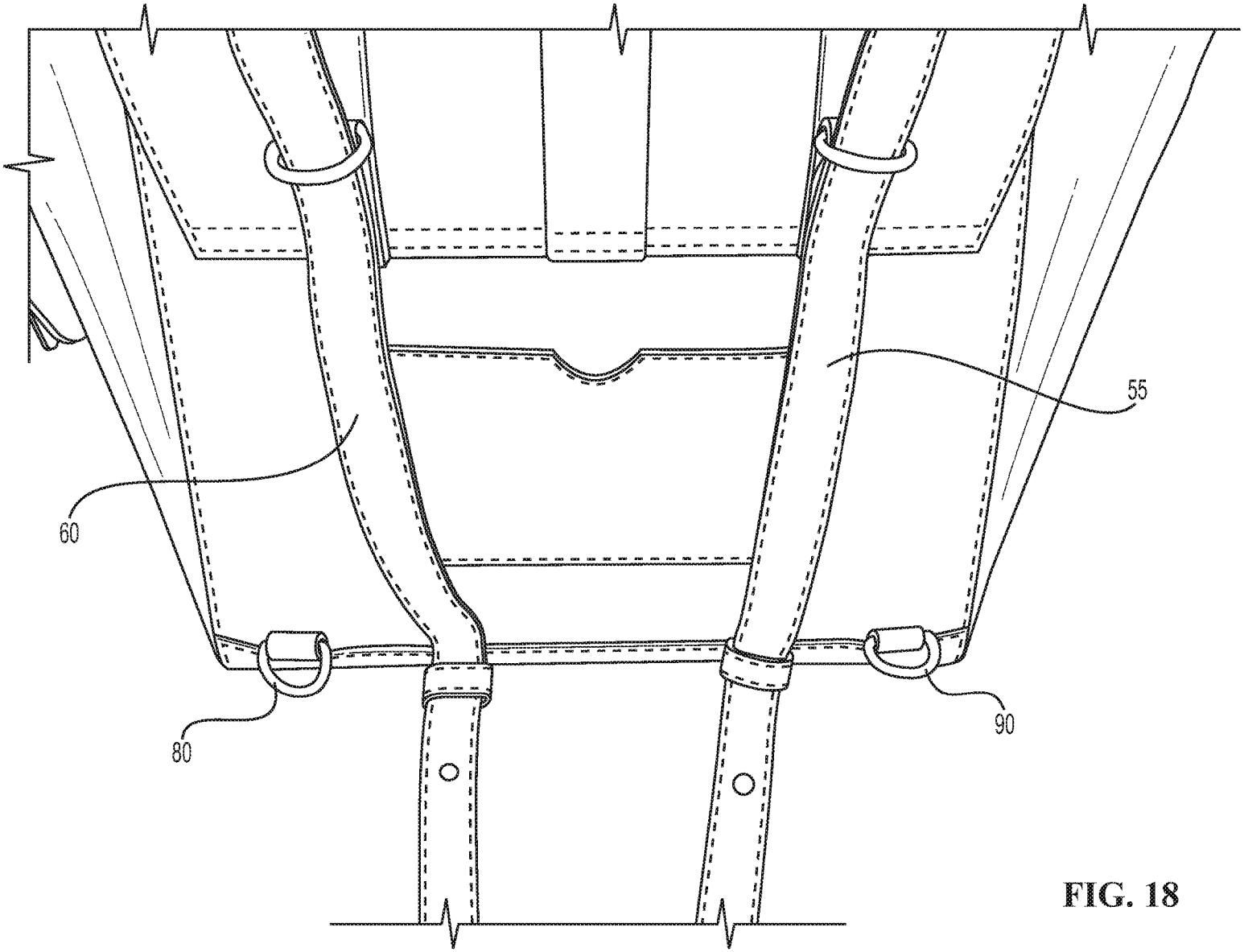
FIG. 18 illustrates yet another detailed view of the four rings with the lower two rings disconnected from the strap, according to an embodiment of the present invention.

FIGS. 15-18 illustrate the removal of the distal ends of the continuous single shoulder strap 54, (left shoulder strap 55 and right shoulder strap 60) according to an embodiment of the present invention. Referring to FIG. 15-17 first the user pulls the portion of the left shoulder strap 55 or right shoulder strap 60 that is proximate to the bottom of the bag 6, i.e. a first distal end or second distal end of the shoulder strap 54, so that they are removed from the shoulder strap loop 70. Then the user pulls the shorter portion (the ends) of the left shoulder strap 55 and right shoulder strap 60 so that the shoulder strap stud 56 disengages from the shoulder strap stud holes 57. There is a plurality of shoulder strap stud holes 57 on the shoulder strap 54. As shown in FIG. 18, once the shoulder strap studs 56 are disengaged with the shoulder strap stud holes 57, the left shoulder strap 55 and right shoulder strap 60 can be slidably removed from the right lower ring 80 and left lower ring 90. FIG. 18 illustrate how the right top ring 75 and left top ring 85 look when the left shoulder strap 55 and right shoulder strap 60 are completely removed from the right lower ring 80 and left lower ring 90.

Figure 19:
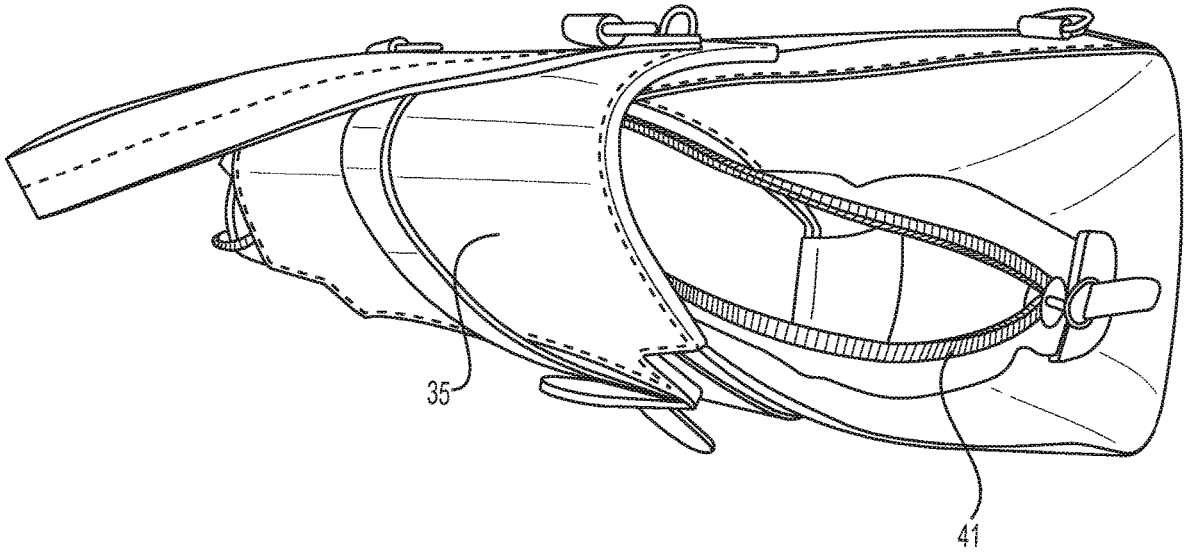
FIG. 19 illustrates a top perspective view of a handbag disconnected to the strap with the flap covering the opening, according to an embodiment of the present invention.
Figure 20:
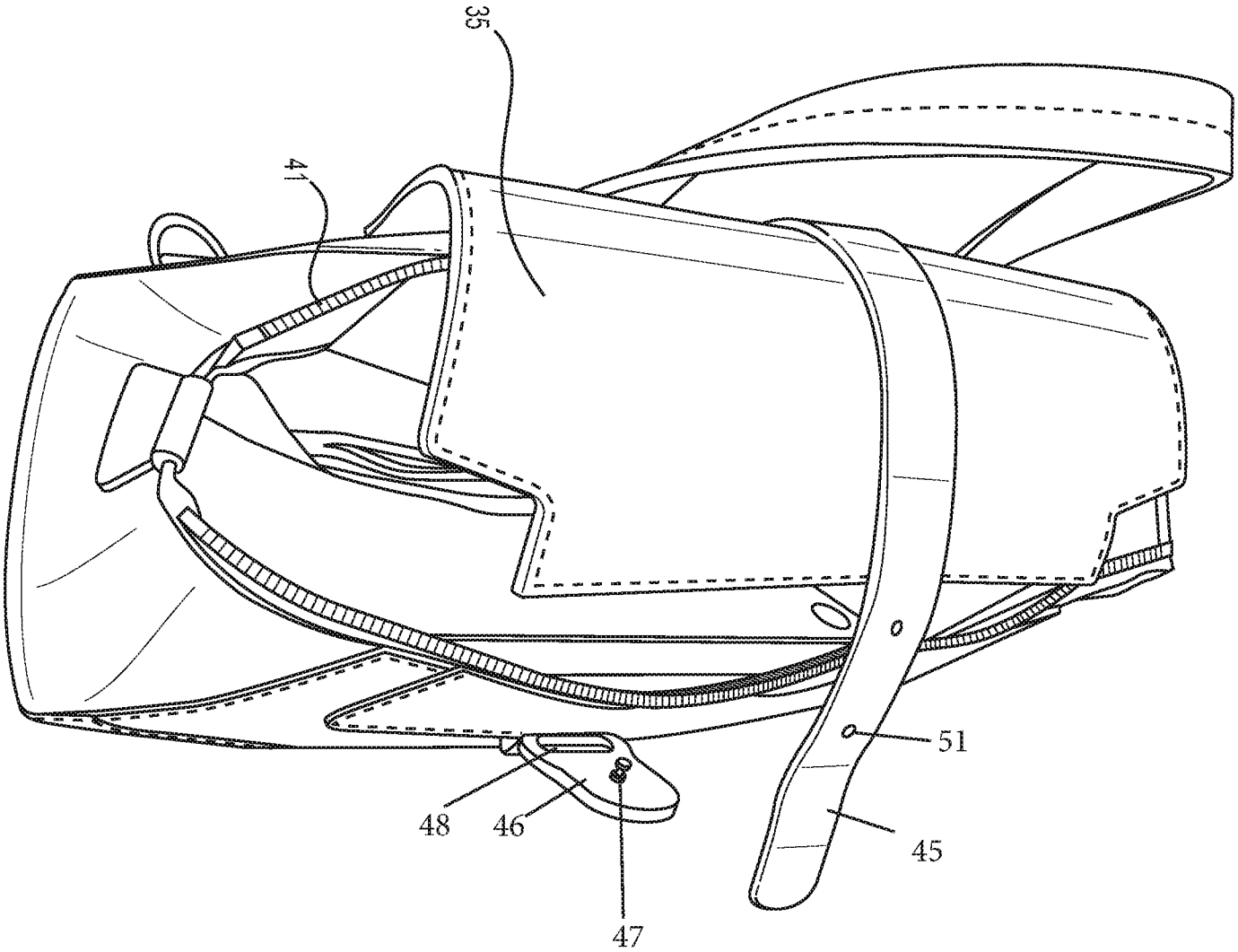
FIG. 20 illustrates a top perspective view of a handbag disconnected to the strap with the flap partially covering the opening, according to an embodiment of the present invention.
Figure 21:
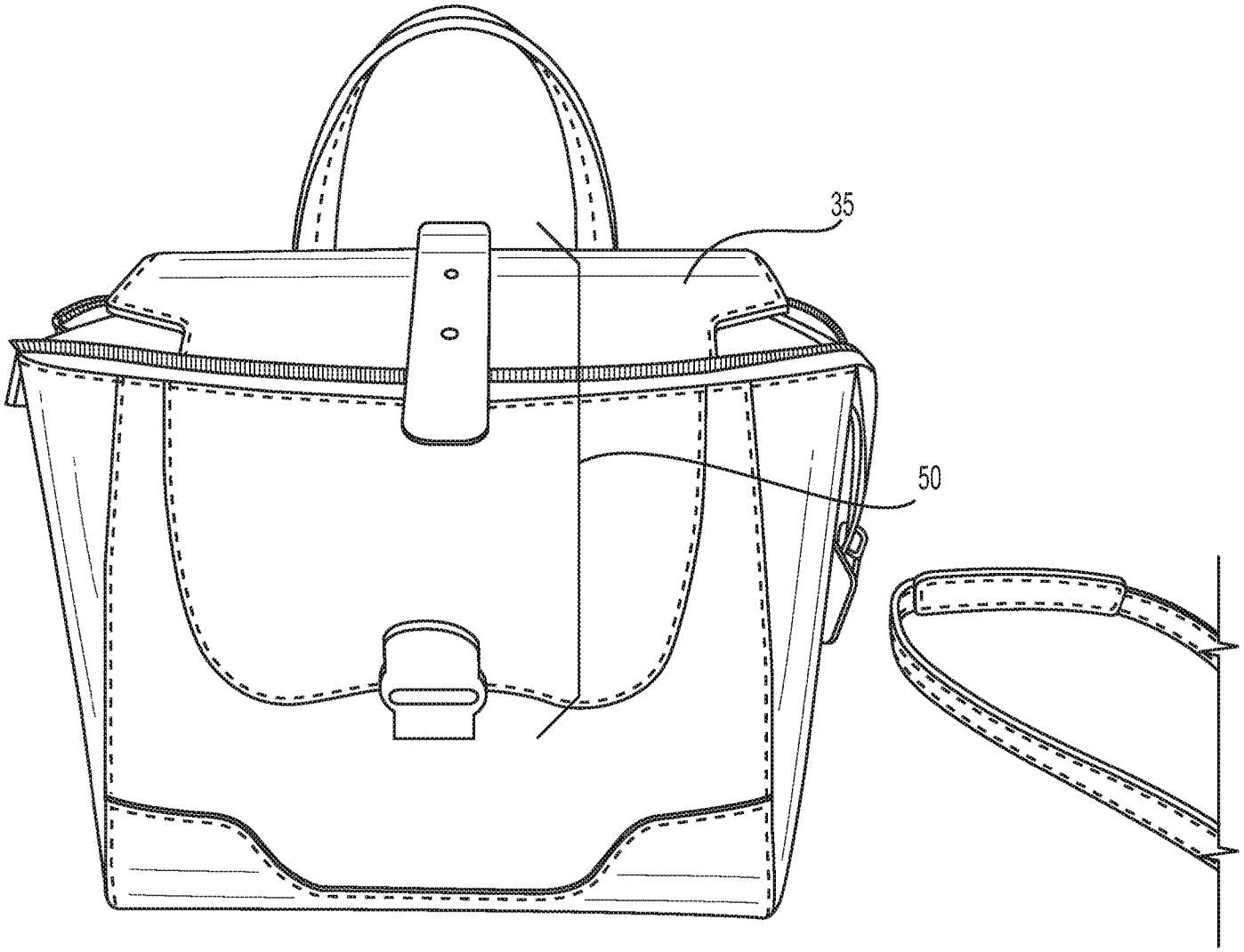
FIG. 21 illustrates a front view of a handbag demonstrating an alternative position for the flap, according to an embodiment of the present invention.

FIGS. 19-21 illustrate how the bag 6 can change from being thin and narrow to a wide bag that can carry a lot of weight, according to an embodiment of the present invention. The zipper 41 can be used to close the bag when there are smaller amounts of items in the bag 6. However, when the zipper 41 cannot close, the user can still secure the bag 6 by covering the opening with the flap 35. If more width is needed, then the flap 35 is not required to fully cover the opening and can be left inside the bag 6 as illustrated in FIG. 21. The position of the flap as illustrated in FIG. 21 can still be secured using the belt loop 50; however, the flap 35 would not entirely cover the opening.

FIG. 20 illustrates the belt loop 50 comprising the secure strap 45, frame 46, belt loop stud 47, belt loop hole 51, and secure strap hole 48, according to an embodiment of the present invention. The secure strap 45 is first threaded through the secure strap hole 48 located on the frame 46. Once the desired length of the secure strap 45 is determined, the frame 46 is pushed against the secure strap 45 so as to have a belt loop stud 47 conjoin with a belt loop hole 51. There is a plurality of belt loop holes 51 made longitudinally along the secure strap 45. In order to unsecure the belt loop 50, one simply pulls on the frame 46 until the belt loop stud 47 disengages with the belt loop hole 51. Then the secure strap 45 is pulled up until it is fully removed from the secure strap hole 48.

Figure 22:
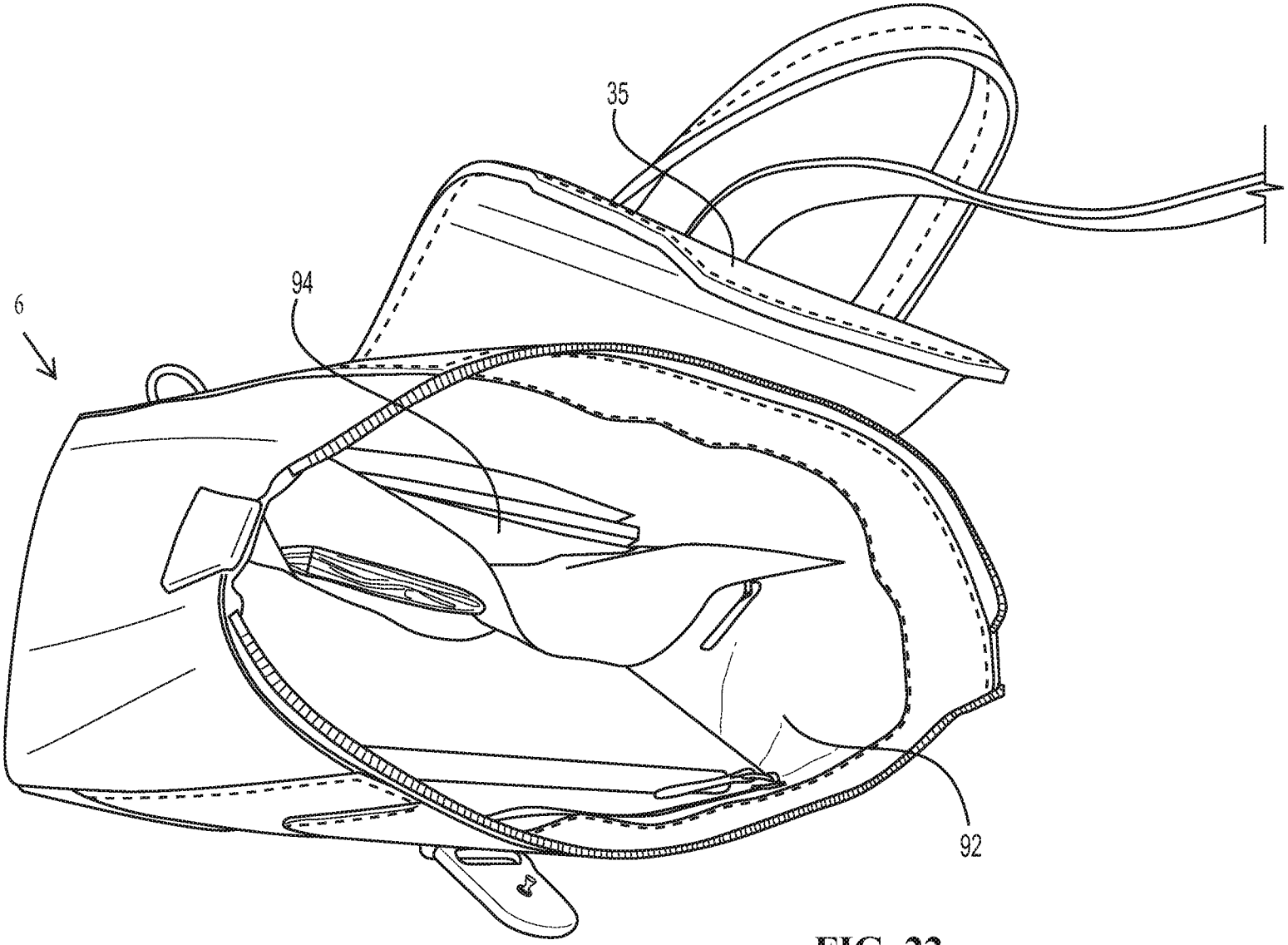
FIG. 22 illustrates the inside of a handbag, according to an embodiment of the present invention.

FIG. 22 illustrates how the bag 6 is opened, according to an embodiment of the present invention. After the belt loop 50 is unsecure, the individual can lift the flap 35. The inside of the bag 6 is covered preferably of stain-resistant micro-suede material. However, any other material that is soft to the touch, elegant and easy to clean can be used. The inside has different compartments to allow the user to organize their belongings and to easily find items quickly. There is a central compartment 92 that allows for large items such as a 15 inch laptop and the like to be stored. There are other interior compartments 94 that comprise at least seven other compartments that can carry a13 inch laptop, keys, mobile devices and the like. The bag 6 is large enough to carry clothing e.g. sweater, documents, and the like.

Figure 23:
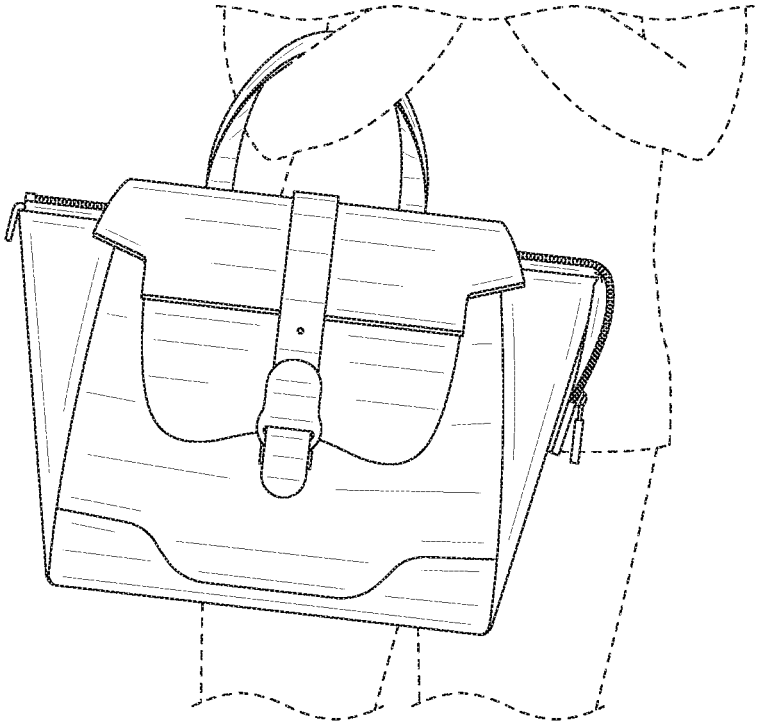
FIG. 23 illustrates the handbag carried in the crook of the elbow, according to an embodiment of the present invention.
Figure 24:
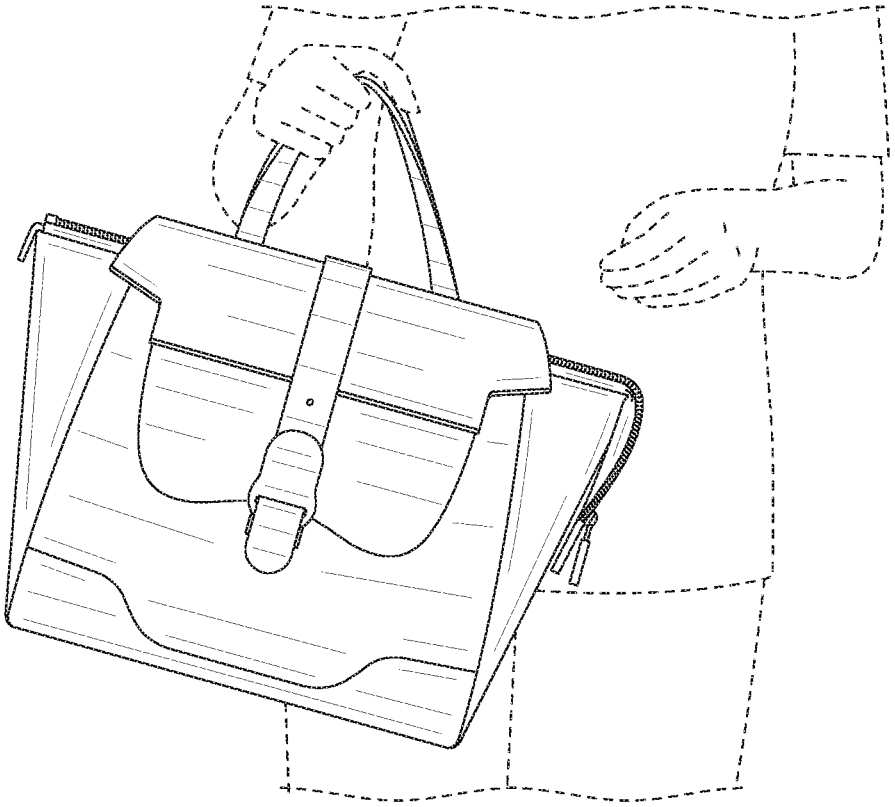
FIG. 24 illustrates the handbag carried by hand, according to an embodiment of the present invention.
Figure 25:
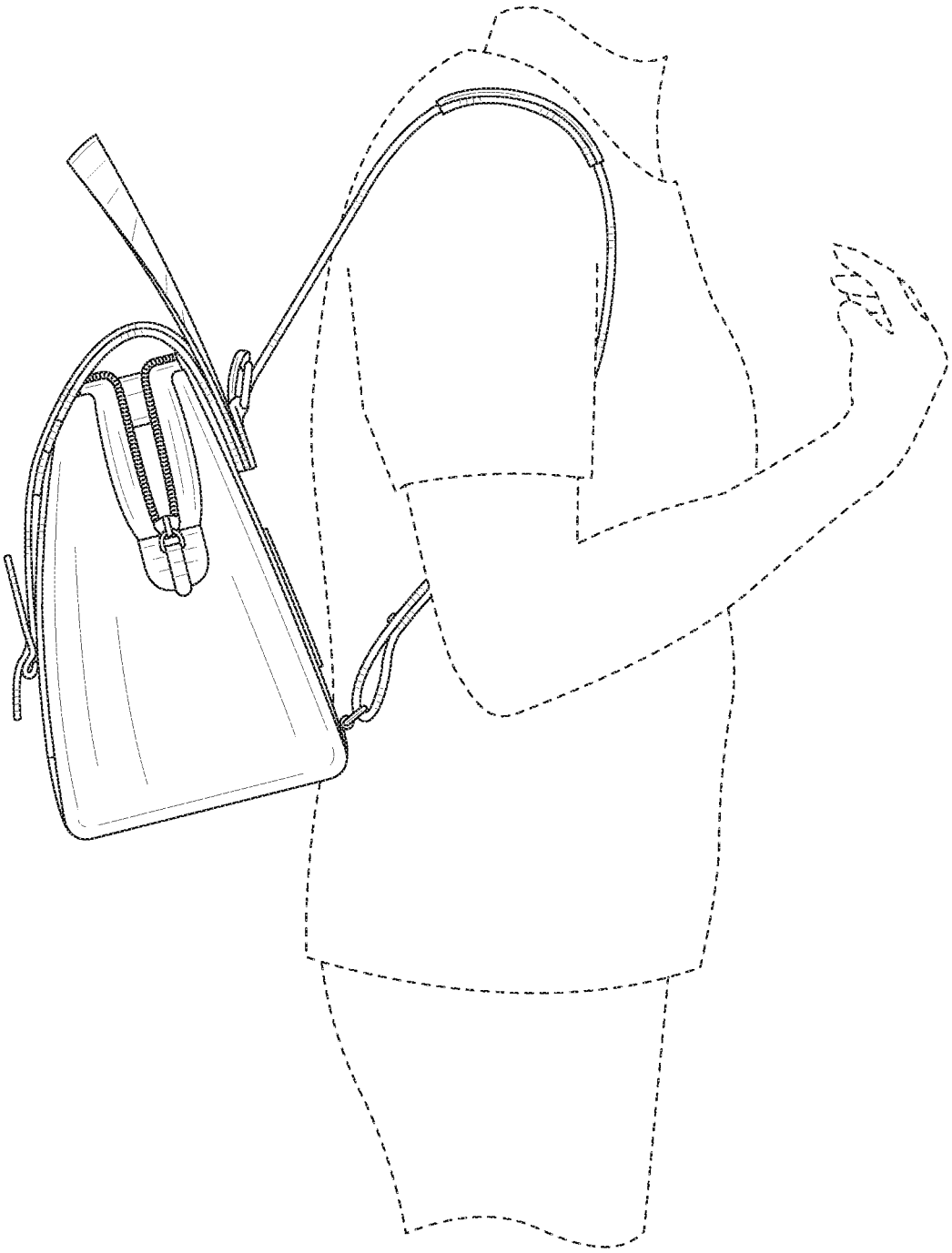
FIG. 25 illustrates the handbag carried in a backpack setting, according to an embodiment of the present invention.
Figure 26:
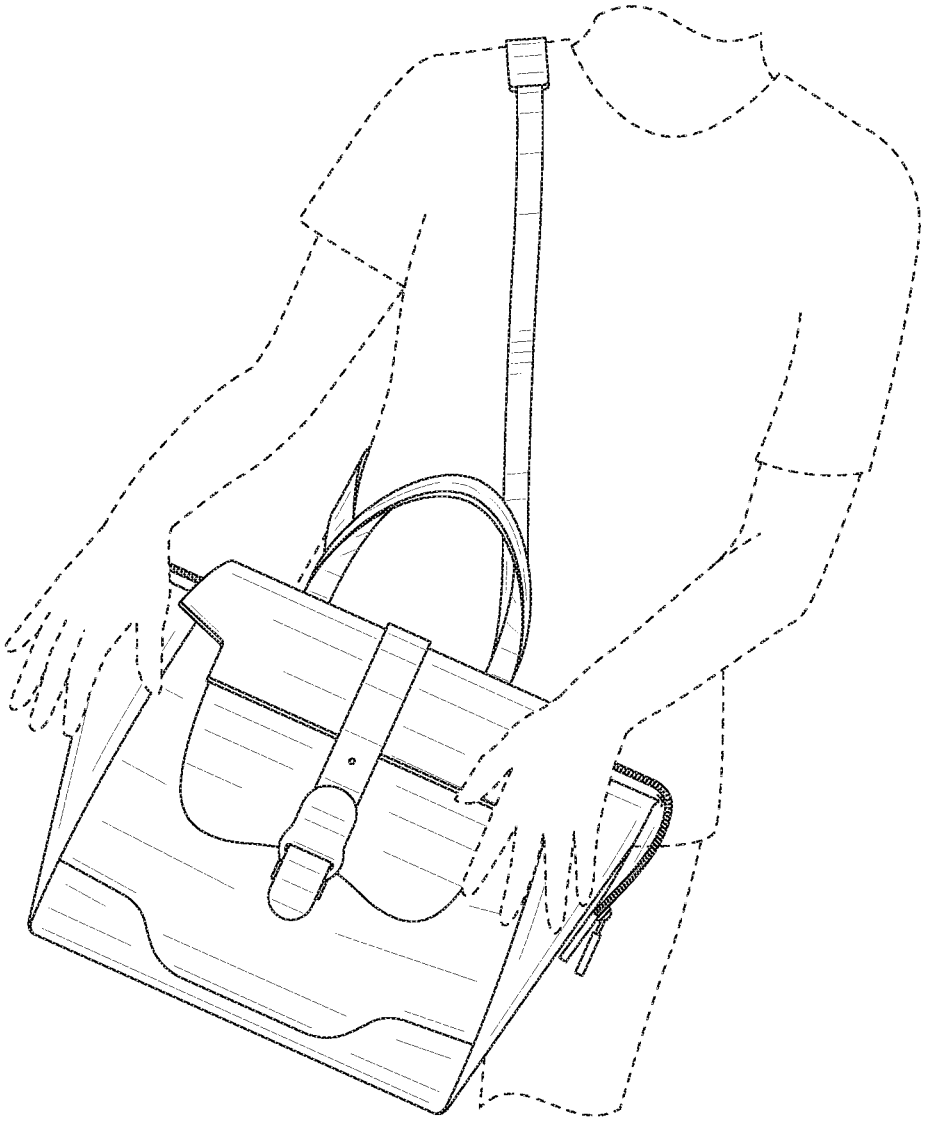
FIG. 26 illustrates the handbag carried in an over one shoulder setting, according to an embodiment of the present invention.
Figure 27:
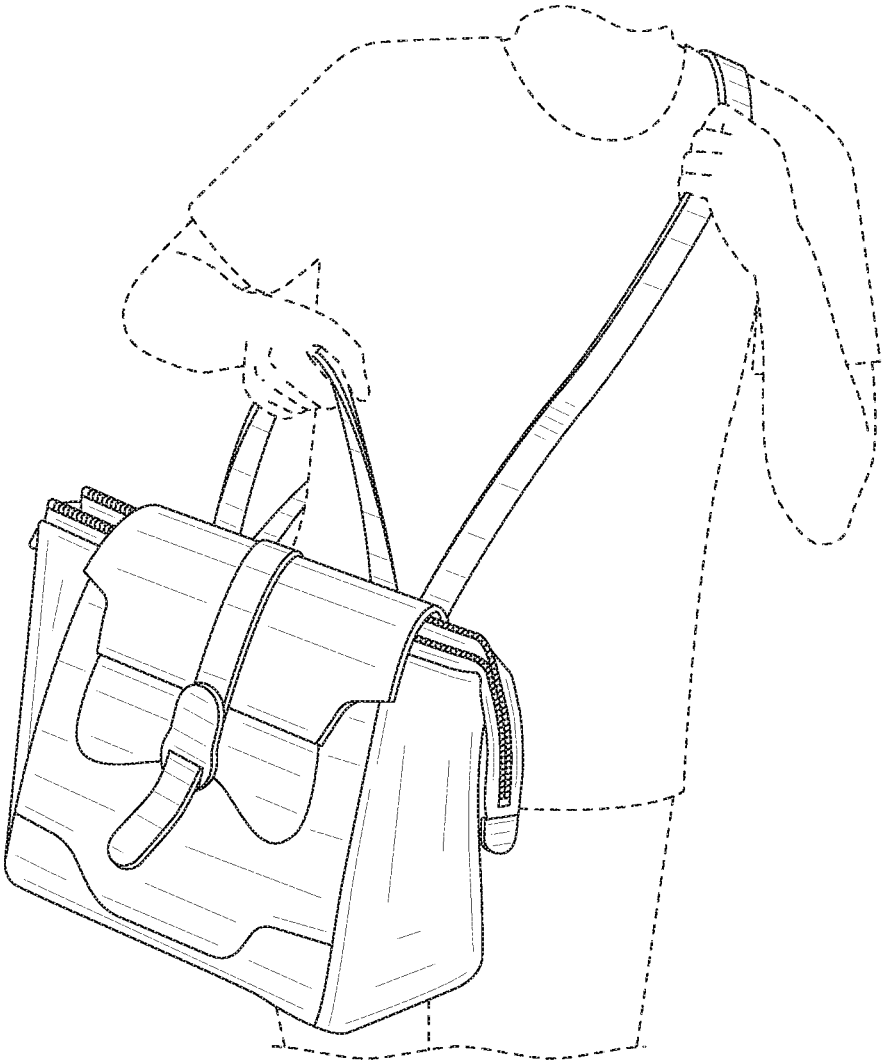
FIG. 27 illustrates the handbag carried in a cross-body setting, according to an embodiment of the present invention.

FIGS. 23-27 illustrate various carrying configurations/settings/modes of the handbag 6. As illustrated in FIG. 23, the handbag 6 can be worn using the handle 40 in the crook of the elbow. This allows the user to keep the handbag 5 close to the body. FIG. 24 illustrates the handbag 5 held in a hand, also using the handle 40. This configuration allows the user to quickly grab the handbag 5 and go. FIG. 25 illustrates the handbag 6 worn as a backpack. This configuration leaves the user's hands free and allows a balanced way of carrying belongings while in movement or standing still. FIG. 26 illustrates the handbag 6 worn over one shoulder. This configuration can be easily obtained by holding onto the shoulder strap 54 and letting go of the bag 6 such that the bag 6 drops to extend the shoulder strap 54, for example from a backpack configuration. FIG. 27 illustrates the handbag 6 worn cross-body. The cross-body configuration allows the user to secure the handbag 6 close to the body and makes it easier for the user to run without having the shoulder strap 54 fall off the shoulder. The user may also hold the 40 handle in this configuration. Transition to this configuration can also be easily achieved by holding onto the shoulder strap 54 and letting go of the bag 6 such that the bag 6 drops to extend the shoulder strap 54, again from a backpack configuration.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

What is claimed is:

1. A convertible strap handbag comprising:

a receptacle having a top flap connected to a back panel and extending over a top of the handbag, a bottom panel extending to meet a front panel and extending to meet a back panel;

a secure belt strap attached to the back panel extending centrally along a vertical direction from the back panel and over the top flap to a free end;

a domed frame having an arched top end, a secure strap hole, and a base end, wherein the secure strap hole is closer in distance to the base end than to the arched top end, a width of the domed frame widens around the secure strap hole then narrows toward the base end, wherein the domed frame is attached to the front panel at the base end and aligned vertically with the secure belt strap, such that the secure strap hole is configured to receive the free end of the secure belt strap;

a right panel connecting right side edges of the front panel to right side edges of the back panel and a left panel connecting left side edges of the front panel to left side edges of the back panel, wherein the right panel and the left panel each flare out beginning from a bottom of the handbag to a widest end at the top of the handbag, each widest end of the right panel and left panel extending horizontally beyond respective side edges of the top flap;

a single strap having a first end, a second end, and a center section, the center section having a first width, and a length of the removable strap extending from each side of the center section to the first end and second end respectively having a second width, wherein the first width of the center section is larger than the second width, and a plurality of spaced apart rings attached to the back panel, through which the strap is engaged, a first set of two rings located at an upper section of the back panel and a second set of two rings located at a lower section of the back panel, a diameter of each of the rings being larger than the second width and smaller than the first width such that the center section is prevented from passing though the rings, wherein the strap is convertible to different carrying configurations without disconnecting the strap after engagement through the rings and securement to the handbag.

2. The handbag as claimed in claim 1, wherein the center section is positioned to rest outside the first set of two rings.

3. The handbag as claimed in claim 1, further comprising a handle attached to the top of the handbag.

4. The handbag as claimed in claim 3, wherein the handle has a length configured for carrying the handbag in a crook of an elbow.

5. The handbag as claimed in claim 1, wherein the domed frame further comprises a belt loop stud on an inner surface.

6. The handbag as claimed in claim 1, wherein the first set of two rings are spaced horizontally apart and the second set of two rings are spaced horizontally apart such that the strap when engaged through the rings is configured for carrying in a backpack setting.

7. The handbag as claimed in claim 1, wherein the strap is secured to the handbag by the first end engaged through one ring of the first set of two rings and the second end engaged through the other ring of the first set of two rings, such that the center section is positioned outside the first set of the two rings at the upper section of the back panel, and the first end engaged through one ring of the second set of two rings and secured in a loop upon itself, and the second end engaged through the other ring of the second set of two rings and secured in a loop upon itself.

8. The handbag as claimed in claim 1, wherein the strap has a length configured for carrying in a single shoulder or cross body setting, upon extending the center section up through the first set of two rings.

9. The handbag as claimed in claim 1, wherein the strap is removable.

10. A convertible strap handbag comprising:

a receptacle having a top flap connected to a back panel and extending over a top of the handbag, a bottom panel extending to meet a front panel and extending to meet the back panel;

a secure belt strap attached to the back panel extending centrally along a vertical direction from the back panel and over the top flap to a free end;

a domed frame having an arched top end, a secure strap hole, and a base end, wherein the secure strap hole is closer in distance to the base end than to the arched top end, a width of the domed frame widens around the secure strap hole then narrows toward the base end, wherein the domed frame is attached to the front panel at the base end and aligned vertically with the secure belt strap, such that the secure strap hole is configured to receive the free end of the secure belt strap;

a right panel connecting right side edges of the front panel to right side edges of the back panel and a left panel connecting left side edges of the front panel to left side edges of the back panel, wherein the right panel and the left panel each flare out beginning from a bottom of the handbag to a widest end at the top of the handbag, each widest end of the right panel and left panel extending horizontally beyond respective side edges of the top flap;

a single removable strap having a first end, a second end;

a plurality of spaced apart rings attached to the back panel, through which the removable strap is reversibly engaged, wherein the first end is engaged through a ring of the plurality of spaced apart rings and secured in a loop upon itself using a stud mating with an opening and the second end is engaged through another ring of the plurality of spaced apart rings and secured in a loop upon itself using a second stud mating with a second opening, wherein the removable strap is convertible from a backpack carrying configuration to shoulder or cross-body carrying configuration without disconnecting the removable strap after engagement through the rings and securement to the handbag.

11. The handbag as claimed in claim 10, wherein the plurality of rings comprise a first set of two rings located at an upper section of the back panel and a second set of two of two rings located at a lower section of the back panel.

12. The handbag as claimed in claim 11, wherein the first set of two rings are attached to the upper back panel and spaced horizontally apart and the second set of two rings are attached to the upper back panel and spaced horizontally apart.

13. The handbag as claimed in claim 10, further comprising a handle attached to the top of the handbag.

14. A method of converting a carrying position of a convertible strap handbag comprising a receptacle having a top flap connected to a back panel and extending over a top of the handbag, a bottom panel extending to meet a front panel and extending to meet the back panel;

a secure belt strap attached to the back panel extending centrally along a vertical direction from the back panel and over the top flap to a free end;

a domed frame having an arched top end, a secure strap hole, and a base end, wherein the secure strap hole is closer in distance to the base end than to the arched top end, a width of the domed frame widens around the secure strap hole then narrows toward the base end, wherein the domed frame is attached to the front panel at the base end and aligned vertically with the secure belt strap, such that the secure strap hole is configured to receive the free end of the secure belt strap;

a right panel connecting right side edges of the front panel to right side edges of the back panel and a left panel connecting left side edges of the front panel to left side edges of the back panel, wherein the right panel and the left panel each flare out beginning from a bottom of the handbag to a widest end at the top of the handbag, each widest end of the right panel and left panel extending horizontally beyond respective side edges of the top flap;

the method comprising:

holding the removable strap at the center section and releasing the handbag to extend a length of the removable strap for an over a shoulder or a cross-body carrying setting.

15. The method of converting a carrying position of a convertible handbag according to claim 14, the method further comprising:

pulling a length of strap between the first set of two rings and the second set of two rings at a left side of the handbag, and pulling a length of strap between the first set of two rings and the second set of two rings at a right side of the handbag, until the center section reaches and stops at the first set of two rings, for conversion to a backpack carrying setting.

16. The method of converting a carrying position of a convertible handbag according to claim 15, the method further comprising: holding the strap at the center section to extend the length of the strap back to the over the shoulder or cross-body carrying setting, without separating the strap or removing the strap from the handbag.

* * * * *